US006983555B2

(12) United States Patent
Lacorazza et al.

(10) Patent No.: US 6,983,555 B2
(45) Date of Patent: Jan. 10, 2006

(54) STABLE FOOTWEAR THAT ACCOMMODATES SHEAR FORCES

(75) Inventors: David Lacorazza, Norwell, MA (US); Paul M. Davis, Blackstone, MA (US)

(73) Assignee: Reebok International Ltd., Canton, MA (US)

( * ) Notice: Subject to any disclaimer, the term of this patent is extended or adjusted under 35 U.S.C. 154(b) by 178 days.

(21) Appl. No.: 10/394,585

(22) Filed: Mar. 24, 2003

(65) Prior Publication Data

US 2004/0187350 A1 Sep. 30, 2004

(51) Int. Cl.
*A43B 7/06* (2006.01)
*A43B 7/08* (2006.01)
*A43B 7/32* (2006.01)

(52) U.S. Cl. ..... 36/30 R; 28/29; 28/3 B; 28/102

(58) Field of Classification Search ..... 36/30 R, 36/28, 29, 35 R, 35 B, 3 B, 102, 103
See application file for complete search history.

(56) References Cited

U.S. PATENT DOCUMENTS

| | | | | |
|---|---|---|---|---|
| 545,705 | A | 9/1895 | MacDonald | |
| 625,393 | A | 5/1899 | Hafertepen | |
| 900,867 | A | 10/1908 | Miller | |
| 1,498,838 | A | 6/1924 | Harrison, Jr. | |
| 2,100,492 | A | 11/1937 | Sindler | |
| 2,288,168 | A | 6/1942 | Leu | |
| 2,751,692 | A * | 6/1956 | Cortina | 36/3 B |
| 2,983,056 | A * | 5/1961 | Murawski | 36/29 |
| 3,719,965 | A | 3/1973 | Chevallereau | |
| 3,785,646 | A | 1/1974 | Ruskin | |
| 3,816,945 | A | 6/1974 | Egtvedt | |
| 3,824,716 | A | 7/1974 | Di Paolo | |
| 3,834,046 | A | 9/1974 | Fowler | |
| 4,183,156 | A | 1/1980 | Rudy | |
| 4,219,945 | A | 9/1980 | Rudy | |
| 4,227,320 | A | 10/1980 | Borgeas | |
| 4,262,433 | A | 4/1981 | Hagg et al. | |
| 4,271,606 | A | 6/1981 | Rudy | |
| 4,307,521 | A | 12/1981 | Inohara et al. | |
| 4,319,412 | A | 3/1982 | Muller et al. | |
| 4,359,830 | A * | 11/1982 | Inohara | 36/29 |
| 4,364,189 | A | 12/1982 | Bates | |
| 4,430,810 | A | 2/1984 | Bente | |
| 4,445,284 | A | 5/1984 | Sakutori | |
| 4,451,994 | A | 6/1984 | Fowler | |
| 4,452,598 | A | 6/1984 | Marsh | |

(Continued)

FOREIGN PATENT DOCUMENTS

| | | |
|---|---|---|
| CA | 1176458 | 10/1984 |

(Continued)

*Primary Examiner*—Anthony Stashick
(74) *Attorney, Agent, or Firm*—Sterne, Kessler, Goldstein & Fox P.L.L.C.

(57) ABSTRACT

A shoe sole is described that provides both cushioning and stability. The sole has a plurality of layers, including a transition layer which allows relative motion between the layers adjacent to the transition layer. The relative motion between the layers of the sole reduces the impact of horizontal shear stresses on the wearer's feet and ankles. One such transition layer includes pliable material and deformable holes within the pliable material. Another transition layer includes at least two rigid plates held together by less rigid grommets or sidewalls. The transition layer may be disposed beneath the entire shoe or only portions of the shoe, with either a more conventional sole structure or rigid support members completing the sole.

18 Claims, 23 Drawing Sheets

U.S. PATENT DOCUMENTS

| | | | | | |
|---|---|---|---|---|---|
| 4,457,084 | A | | 7/1984 | Horibata et al. | |
| 4,507,879 | A | | 4/1985 | Dassler | |
| 4,535,553 | A | | 8/1985 | Derderian et al. | |
| 4,546,556 | A | | 10/1985 | Stubblefield | |
| 4,547,979 | A | | 10/1985 | Harada et al. | |
| 4,576,279 | A | | 3/1986 | Ferderber | |
| 4,593,482 | A | | 6/1986 | Mayer | |
| 4,624,061 | A | | 11/1986 | Wezel et al. | |
| 4,656,760 | A | * | 4/1987 | Tonkel et al. | 36/28 |
| 4,680,875 | A | | 7/1987 | Danieli | |
| 4,754,559 | A | | 7/1988 | Cohen | |
| 4,782,603 | A | | 11/1988 | Brown | |
| 4,798,010 | A | | 1/1989 | Sugiyama | |
| 4,864,737 | A | | 9/1989 | Marrello | |
| 4,890,397 | A | * | 1/1990 | Harada et al. | 36/30 R |
| 4,914,836 | A | | 4/1990 | Horovitz | |
| 4,922,631 | A | | 5/1990 | Anderie | |
| 4,924,605 | A | | 5/1990 | Spademan | |
| 5,005,300 | A | * | 4/1991 | Diaz et al. | 36/28 |
| 5,012,597 | A | | 5/1991 | Thomasson | |
| 5,220,737 | A | * | 6/1993 | Edington | 36/28 |
| 5,224,810 | A | | 7/1993 | Pitkin | |
| 5,313,718 | A | | 5/1994 | McMahon et al. | |
| 5,373,649 | A | | 12/1994 | Choi | |
| 5,456,027 | A | | 10/1995 | Tecchio et al. | |
| 5,481,814 | A | | 1/1996 | Spencer | |
| 5,595,002 | A | * | 1/1997 | Slepian et al. | 36/35 R |
| 5,595,003 | A | * | 1/1997 | Snow | 36/28 |
| 5,685,092 | A | | 11/1997 | Prieskorn | |
| 5,784,808 | A | | 7/1998 | Hockerson | |
| 5,993,585 | A | * | 11/1999 | Goodwin et al. | 36/29 |
| 5,996,253 | A | * | 12/1999 | Spector | 36/29 |
| 6,115,943 | A | * | 9/2000 | Gyr | 36/35 R |
| 6,119,371 | A | * | 9/2000 | Goodwin et al. | 36/29 |

FOREIGN PATENT DOCUMENTS

| | | |
|---|---|---|
| CH | 483 807 | 2/1970 |
| EP | 0 192 820 | 9/1986 |
| WO | WO 91/15973 | * 10/1991 |

* cited by examiner

STABLE FOOTWEAR THAT ACCOMMODATES SHEAR FORCES

BACKGROUND OF THE INVENTION

1. Field of the Invention

The present invention relates to footwear, and in particular to an article of footwear designed to accommodate vertical forces and horizontal shear forces, both acting as the result of a foot strike, change in motion of the wearer, or both.

2. Background of the Invention

Soles in footwear, and especially athletic footwear, are designed to provide cushioning and stability. The cushioning aspect is normally designed to minimize the impact in the vertical direction caused when the wearer's body weight, moving in a downward vertical direction, acts on a wearer's foot as it strikes the ground. The stability feature is necessary to control the amount of horizontal motion of a wearer's foot in relation to a securely planted outsole of the footwear.

Historically, due to a focus on the negative effects of vertical forces resulting from footstrikes during walking and running, many attempts have been made at providing optimal vertical shock absorption.

During normal walking or running, the largest forces acting on a wearer's body are in the vertical direction. However, horizontal shear forces are also acting on a wearer's body. For example, as the foot of a person strikes the ground, the heel strikes first. The foot then rolls forwardly and inwardly over the ball of the foot. During the time that the foot is rolling forward, the foot also pronates, a process by which the foot rolls from the lateral side to the medial side. This pronation causes horizontal shear forces to act on the wearer's foot. The lateral motion of the foot resulting from the horizontal shear forces can be controlled by providing stability in the sole of the footwear. However, as the horizontal stability of the footwear increases, the horizontal shock absorption properties of the footwear decrease.

Horizontal shear forces also act on a wearer's body during starting, stopping, and shifting of direction, due to friction between the ground and the shoe. This force of friction is transferred by the shoe to the wearer's foot. Such horizontal shear forces may cause injury to the wearer's ankles if the friction causes the shoe to stop before the wearer's foot can adjust to the change of motion. Attempts have been made to reduce the impact of horizontal shear forces on a wearer's body. For example, posting in a shoe helps to prevent over-pronation of the foot. Once again however, as the stability of such footwear has been increased to accommodate for the horizontal shear forces, the horizontal and vertical shock absorption properties of the footwear have decreased.

Accordingly, a need exists to develop footwear that provides optimal horizontal stability with optimal horizontal absorption properties.

SUMMARY OF THE INVENTION

To achieve the foregoing and other objects, and in accordance with the purposes of the present invention as embodied and broadly described herein, there is fully described herein an article of footwear, which is preferably an athletic shoe with an upper, but could also be a sandal, a walking shoe, a dress shoe, or any other type of shoe. At least a portion of the sole includes a shear sole. The shear sole has multiple layers, including an upper layer, which is attached to the upper, a lower layer, and a transition layer disposed between at least a portion of the upper and lower layers. The transition layer allows for relative motion between the upper and lower layers. This relative motion absorbs horizontal shear forces, yet maintains desirable horizontal shock absorption properties.

Generally, the shear sole comprises at least three layers. A first and second layer are made of a resilient material. A transition layer, disposed between the first and second layers, is provided to allow relative motion between the first and second layers. The transition layer may completely separate the first and second layers or only a portion thereof. Finally, a separate ground engaging outsole may be provided, if necessary.

In a first embodiment of the present invention the transition layer comprises a more flexible material than that of the first and second layers. A plurality of deformable holes are contained within the more-flexible material. The transition layer is disposed between the first and second layers only on a lateral side of a heel section of the footwear. The deformable holes run horizontally through the transition layer from a lateral edge to a medial edge of the shoe. A more-resilient, lightweight support structure replaces the shear sole in a medial portion of the heel section. Additionally, a conventional sole which contains no transition layer, only a first layer, a second layer, and an outsole, is disposed in the forefront section of the footwear.

In another embodiment of the present invention, the shear sole configuration, including the ground engaging outsole, comprises the entire sole of the shoe. The transition layer again comprises a more flexible material than that of the first and second layers. Deformable holes disposed within the transition layer run horizontally therethrough from a lateral edge to a medial edge of the shoe or longitudinally therethrough from a proximal edge to a distal edge of the shoe.

Another embodiment of the present invention includes the shear sole, with the ground engaging outsole, comprising the entire heel portion of the shoe. The transition layer comprises a more flexible material than that of the first and second layers, with deformable holes disposed therein. The deformable holes run horizontally through the transition layer from a lateral edge to a medial edge of the shoe. The conventional sole in the forefoot region of this embodiment contains no transition layer, but only a first layer, a second layer, and an outsole.

In yet another embodiment of the present invention, the shear sole includes a first layer, a transition layer, and an outsole. The transition layer comprises a more flexible material than that of the first layer, with deformable holes disposed therein. The deformable holes in the transition layer run horizontally through the transition layer, in a general toe-to-heel direction. The shear sole is placed only in the medial forefoot region of the shoe. The lateral forefoot section and the heel section of the sole contains no transition layer, only a first layer, a second layer, and an outsole.

In a further embodiment of the present invention, the transition layer comprises two uniformly-sized plates of a stiff material with holes drilled therethrough. Grommets are disposed within the holes, joining the plates while permitting a small amount of relative motion therebetween. Rubber sleeves encase the edges of the plates. The transition layer is then located between the first and second layers or between the first layer and the ground-engaging layer in either the heel region or forefront of the shoe.

BRIEF DESCRIPTION OF THE DRAWINGS/FIGURES

The foregoing and other features and advantages of the invention will be apparent from the following, more particular description of a preferred embodiment of the invention, as illustrated in the accompanying drawings.

DETAILED DESCRIPTION OF THE INVENTION

Preferred embodiments of the present invention are now described with reference to the figures, where like reference numbers indicate identical or functionally similar elements. Also in the figures, the left most digit of each reference number corresponds to the figure in which the reference number is first used. While specific configurations and arrangements are discussed, it should be understood that this is done for illustrative purposes only. A person skilled in the relevant art will recognize that other configurations and arrangements can be used without departing from the spirit and scope of the invention.

Figure 1:
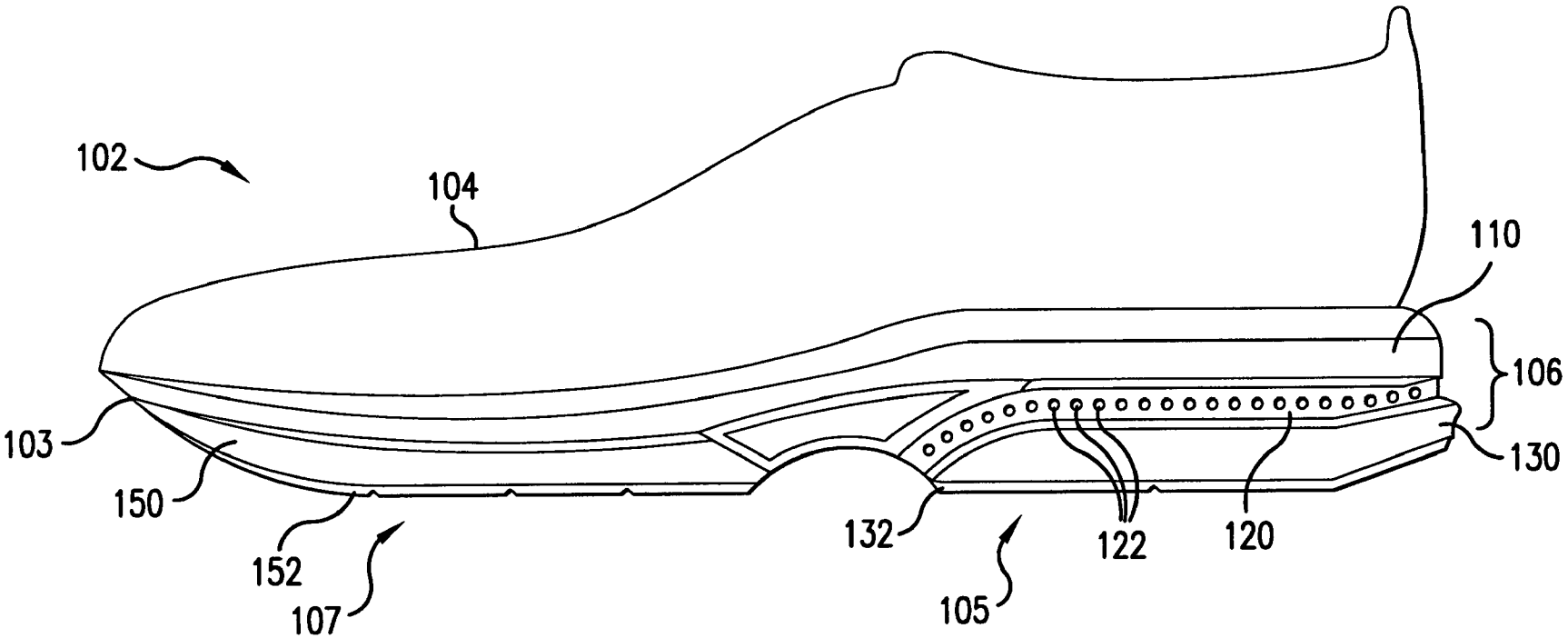
FIG. 1 is a lateral side view of an article of footwear according to a first embodiment of the present invention.

FIG. 1 depicts a lateral side view of a shoe 102 according to the present invention. Shoe 102 is preferably an athletic shoe, such as a running shoe, although the present invention is not limited to athletic shoes, but could also be any article of footwear, such as a sandal, a dress shoe, or the like. A left foot shoe is shown, but it will be apparent to one of ordinary skill in the art that a right foot shoe is a mirror image thereof. Shoe 102 preferably comprises an upper 104 and a sole 103. A shear sole 106 preferably comprises three layers and is disposed under and supports a lateral side of a heel region 105 of shoe 102. A first layer 110 is preferably made of a resilient material, such as a high-density foam or rubber. A second layer 130 disposed beneath first layer 110 is also preferably made of a resilient material, preferably the same material as first layer 110, although the other materials described above may also be used.

A transition layer 120 is disposed between first layer 110 and second layer 130. The layers can be co-injection molded, thermally bonded, or adhered with glue. Transition layer 120 is made of a more flexible material than first layer 110 and second layer 130, such as ethyl vinyl acetate (EVA), although many different materials may be used to construct transition layer 120. For example, transition layer 120 may be made of rubber, flexible plastic, low-density foam, or a gel-filled shell.

Figure 1A:
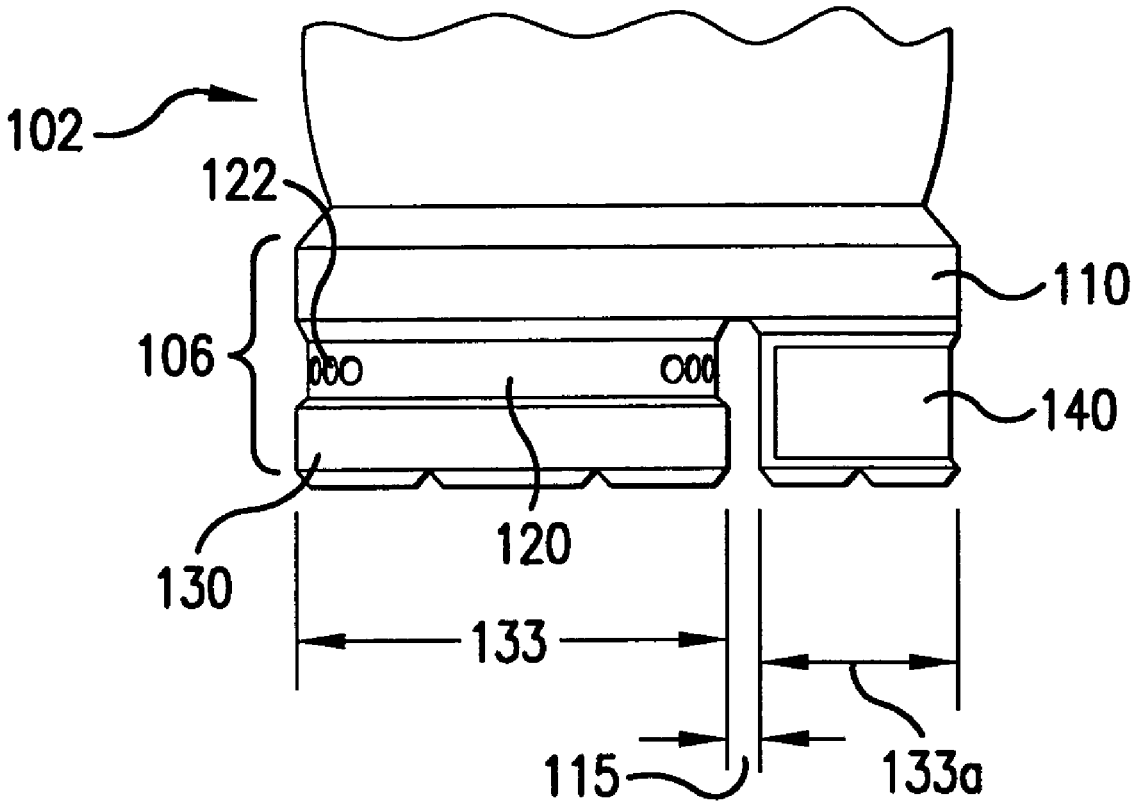
FIG. 1A is a rear heel view of the left foot of an article of footwear according to a first embodiment of the present invention.

Transition layer 120 preferably contains a plurality of deformable holes 122. In the embodiment shown in FIG. 1, deformable holes 122 are disposed horizontally within transition layer 120. However, deformable holes 122 could also be disposed vertically within transition layer 120 without departing from the scope of the invention. As shown in FIG. 1A, transition layer 120 and deformable holes 122 run from a lateral side of shoe 102 to a point approximately two-thirds of the width of heel 105. Flexible material and deformable holes 122 make transition layer 120 more pliable than first layer 110 and second layer 130. Accordingly, transition layer 120 may deform, allowing for relative motion between first layer 110 and second layer 130. If transition layer 120 is made of a sufficiently flexible material, holes 122 could be eliminated.

A ground-engaging layer 132, also referred to herein as an outsole, may be disposed in contact with second layer 130 oppositely from transition layer 120. Ground-engaging layer 132 is preferably made of an extremely resilient, wear-resistant material, such as rubber. Alternatively, second layer 130 maybe formed with a ground engaging surface.

It will be appreciated by those skill in the relevant art that the main purpose of transition layer 120 is to allow relative motion between the wearer's foot and the ground-engaging layer, so that sole 106 can absorb a portion of the horizontal shear forces generated by suddenly stopping forward or lateral motion and thereby reduce the possibility of injury to the wearer's foot or ankle. Therefore, although the preferred embodiment includes a sole including multiple layers with transition layer 120 sandwiched therebetween, those skilled in the art will recognize that transition layer 120 may be disposed anywhere on or in the sole between the foot and the ground. For example, first layer 110 could be eliminated entirely. In this embodiment, not shown in the figures, transition layer 120 is disposed beneath and attached to at least a portion of upper 104 and second layer 130 is disposed beneath transition layer 120. Similarly, again not shown in the figures, second layer 130 could be eliminated entirely, and transition layer 120 is disposed between first layer 110 and ground-engaging layer 132. In yet another possibility, not shown in the figures, both first layer 110 and second layer 130 could be eliminated. In such a case, transition layer 120 is disposed between and attached to upper 104 and ground-engaging layer 132.

It will be appreciated by those skilled in the art that the features of the invention may be altered to tailor the characteristics of the shoe. For example, the support material in the layers of the sole may be made of a variety of materials, including but not limited to plastic, foam, and rubber. The various layers may be secured to each other using any one of the many well known methods in the art.

Construction of the various layers may be accomplished by any one of the many methods known in the art. For instance, the layers may be formed by injection molding, compression molding, or other suitable methods. Also, it is contemplated that the different layers that compose the various sole designs described herein can be replaced by one single layer of material, in which the density, flexibility, and pliability differs throughout the material, thereby performing the same function of allowing uneven compression and shearing as described herein.

In the embodiment shown in FIG. 1, shear sole 106 is disposed under and supports a lateral side of heel region 105 of shoe 102. As shown in FIG. 1A, first layer 110 and a hard, lightweight, support 140 are disposed under arch 142 and a medial side of heel region 105 of shoe 102 in order to provide arch support. Support 140 is constructed from, for example, plastic, composites such as carbon or graphite epoxy, or metal. First layer 110, a forefoot resilient layer 150, and an outsole 152 support a forefoot region 107 of shoe 102.

Accordingly, as shown in FIG. 1A, shear sole 106 occupies a lateral side 133 of the heel portion of shoe 102. Deformable holes 122 are disposed horizontally within transition layer 120 and span lateral side 133 of shoe 102. First layer 110 and hard, lightweight support 140 occupy a medial side 133*a* of heel region 105 of shoe 102.

Shear sole 106, occupying lateral side 133, and support 140, occupying medial side 133*a*, are spaced apart creating a gap 115 therebetween. Gap 115 allows transition layer 120, second layer 130, and optional outsole 132 to move independently of support 140. Accordingly, the design allows for flexibility on lateral side 133 of shoe 102 to accommodate for uneven downward pressure and horizontal shear forces resulting from, for example, a typical footstrike, starting, stopping, or turning. The design also allows for stability on medial side 133*a* of heel 105 for support of the wearer's foot.

Figure 1B:
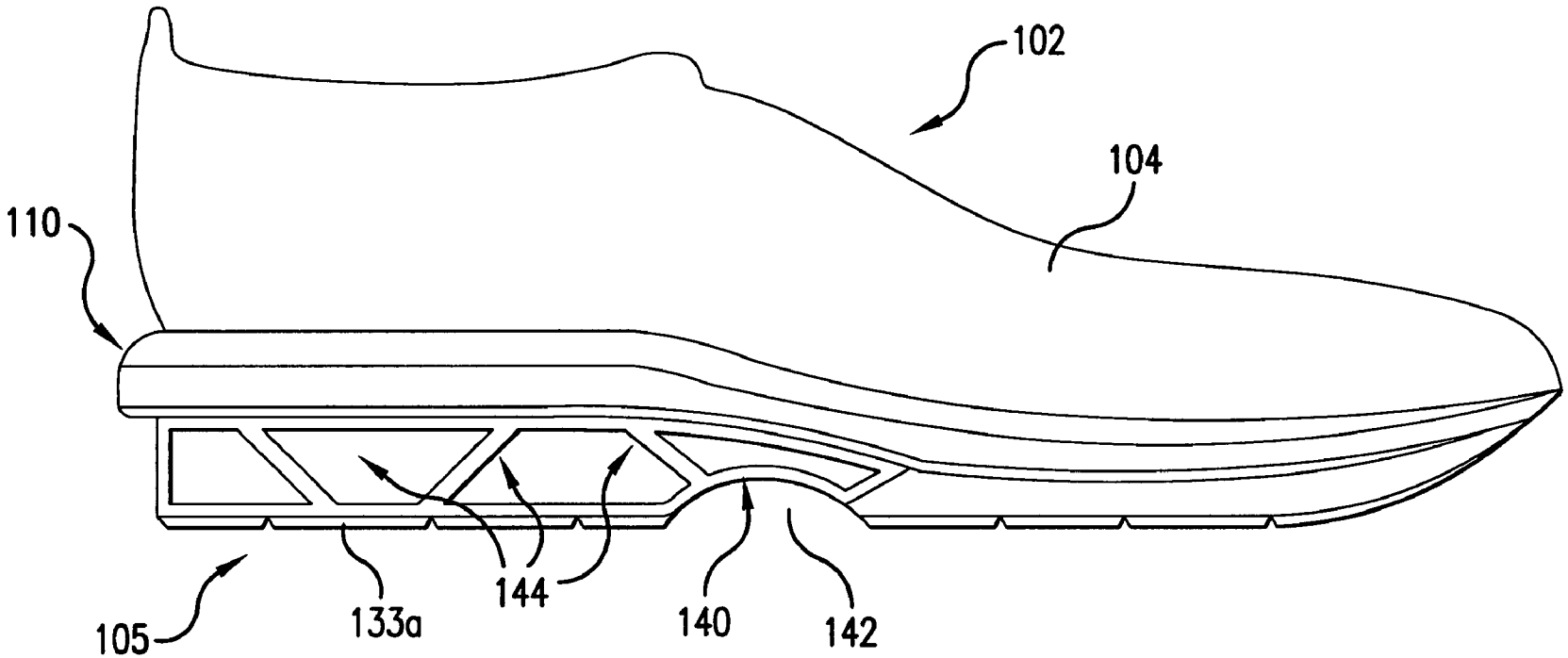
FIG. 1B is a medial side view of an article of footwear according to a first embodiment of the present invention.
Figure 1C:
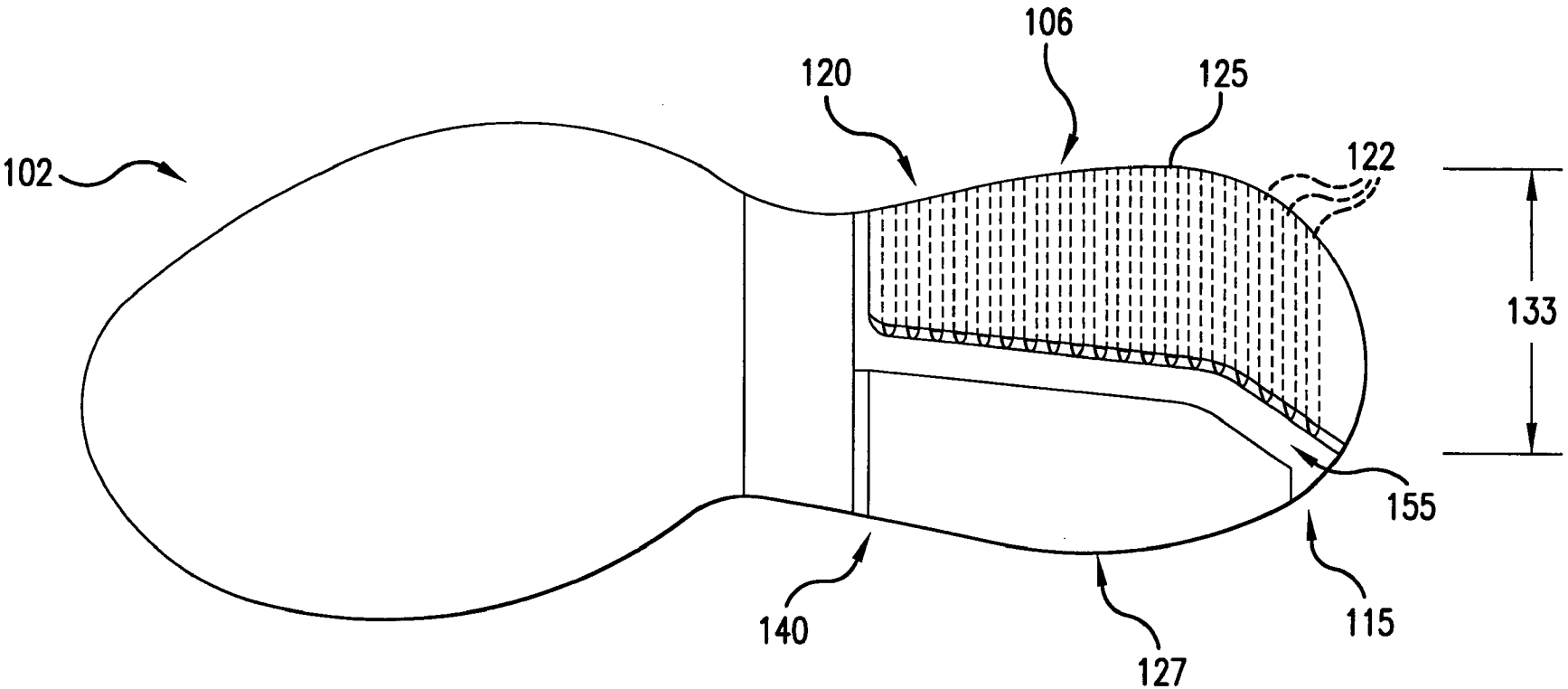
FIG. 1C is a bottom plan view of an article of footwear according to a first embodiment of the present invention.

Referring to FIGS. 1B and 1C, support 140 spans the footwear from heel 105 to an arch 142. Support 140 may be sufficiently firm to allow little or no compression or motion on medial side 133*a* of heel 105 during, for example, a footstrike, starting, stopping, or turning. In one embodiment, support 140 comprises several support bars 144, which provide firmness to support 140. The location, number, orientation, and material of support bars 144 of support 140 may vary. Support bars 144 may be oriented vertically, diagonally, horizontally, or any combination thereof. Support bars 144 may or may not be made of the same material as the remainder of support 140. Alternatively, support bars 144 may be eliminated from support 140.

As shown in FIG. 1C, transition layer 120 occupies only lateral side 133 of heel 105. Shear sole 106, including pliable transition layer 120 with deformable holes 122, extends from a lateral edge 125 to gap 115. Further, gap 115 extends towards the center of shoe 102, forming a channel 155 that separates shear sole 106 from support 140, thereby allowing movement of shear sole 106 independent from the remainder of sole 103.

Figure 1D:
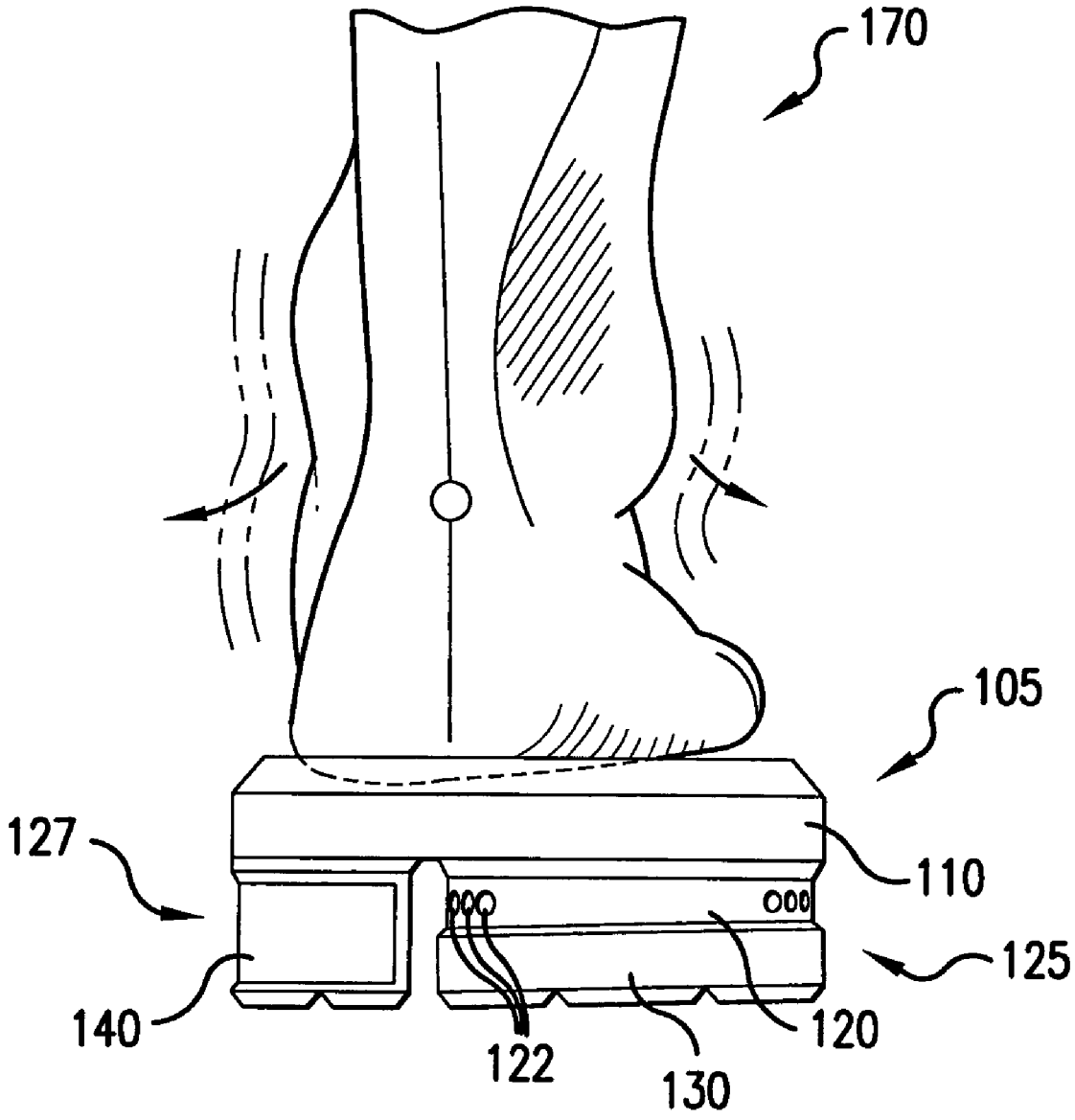
FIG. 1D is a rear heel view of the right foot of an article of footwear according to a first embodiment of the present invention depicting the shoe as the wearer is running.

Referring now to FIG. 1D, shoe 102, as described with reference to FIGS. 1–1C is shown as it would look under normal walking or running conditions. A right foot shoe is shown, although one of ordinary skill in the art would recognize that the left foot shoe is the mirror image of the right foot shoe. With this design, only lateral side 125 of heel 105 contains transition layer 120. As is typical, a wearer's foot 170 strikes with lateral side 125 of heel 105 first. Transition layer 120 accounts for and reduces both the horizontal and vertical forces created by the foot strike. As foot 170 rolls medially and forwardly during the ground contact, the horizontal shear forces would transition from lateral side 125 of heel 105 onto support 140, located under medial side 127 of heel 105. Support 140 would remain firm and provide more medial support. This embodiment accounts for longitudinal motion (a shearing in the heel-to-toe) in transition layer 120 but also adds stability with support 140.

The flexibility of transition layer 120 may be tailored by modifying various characteristics of the material of transition layer 120. It will be appreciated by those skilled in the art that the thickness, density, and firmness of the material used for the transition layer 120 may be adjusted to allow for varying degrees of compression and shearing under different conditions. Similarly, transition layer 120 may be made of a diffuse, thick material, such as a very low density foam, allowing for a greater degree of motion or a dense, thin, hard material, such as rubber, allowing for less motion. Additionally, the density and thickness may be varied within transition layer 120.

The flexibility of transition layer 120 may be further tailored by altering the characteristics of deformable holes 122. For example, the diameter of deformable holes 122 may be altered. Increasing the diameter of deformable holes 122 leads to greater flexibility and range of motion in transition layer 120. Decreasing the diameter of deformable holes 122 leads to greater rigidity and a lesser range of motion in transition layer 120. Additionally, the diameter of deformable holes 122 may vary throughout the sole. Also, the distance between deformable holes 122 may vary, with greater distance limiting the motion and flexibility of the sole.

Deformable holes 122, as well as deformable holes of embodiments described below, deform most easily into a diagonal oval shape, moving the material above and below them in opposite directions. Accordingly, deformable holes 122 shear with less force in a direction perpendicular to the axial direction in which they run. Therefore, altering the orientation of the deformable holes 122 through transition layer 120 allows one skilled in the art to tailor the direction in which shearing most easily occurs. For example, deformable holes disposed horizontally within a transition layer, running from a lateral edge to a medial edge of a shoe, as described with respect to FIG. 2, shear more easily in a heel-to-toe direction than in a medial-to-lateral direction. On the other hand, deformable holes that follow the curvature of the shoe, as described below with respect to FIG. 5, create a shearing gradient, where horizontal cushioning is always greatest perpendicular to a tangent to the wearer's foot. Further, deformable holes could be drilled into the material of transition layer 120 in a heel-to-toe direction (not shown). Such an orientation would be preferred in the forefront region. Further, transition layer 120 may be injection molded, manually carved, or otherwise manufactures so that deformable holes are disposed vertically within transition layer 120. Deformable holes 122 may then be placed in patterns throughout transition layer 120. Accordingly, one skilled in the art will appreciate that deformable holes may be arranged in a heel-to-toe orientation, a medial-to-lateral orientation, and any orientation therebetween, depending on the desired orientation of the cushioning and stability.

Figure 2:
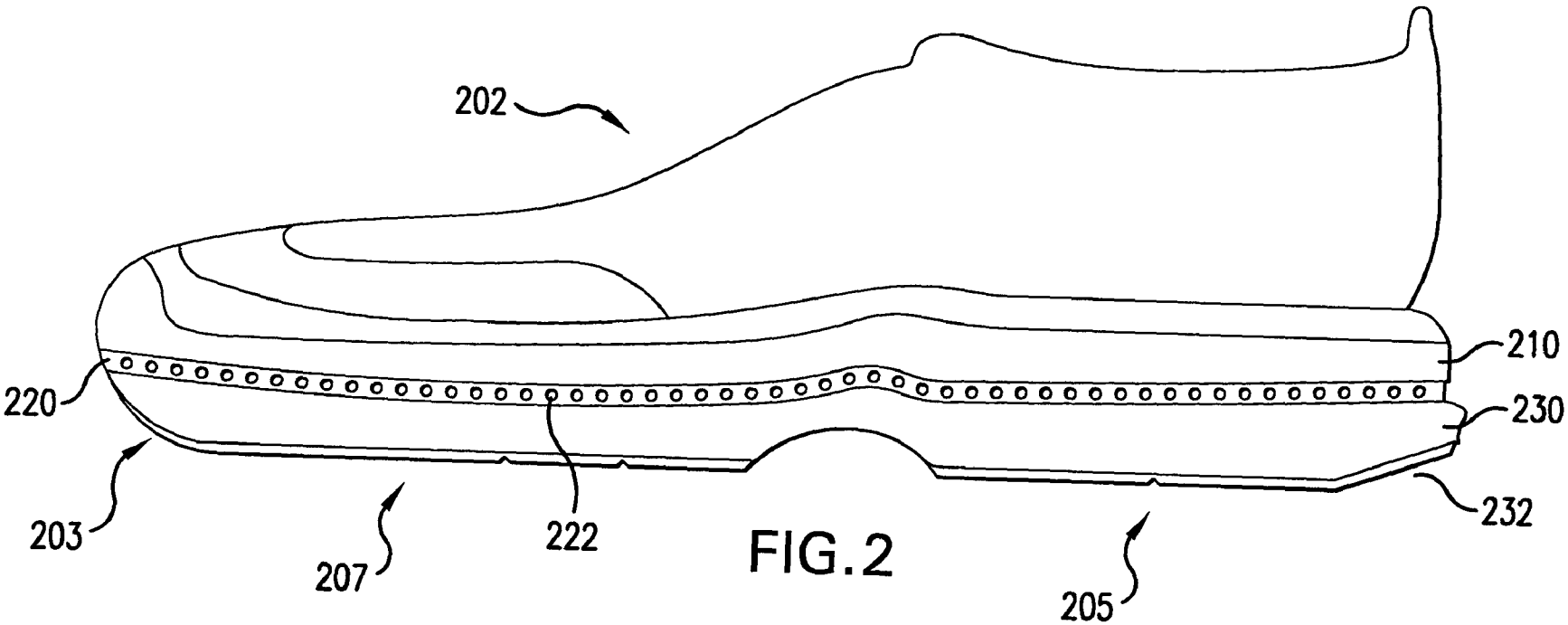
FIG. 2 is a lateral side view of an article of footwear according to a second embodiment of the present invention.
Figure 2A:
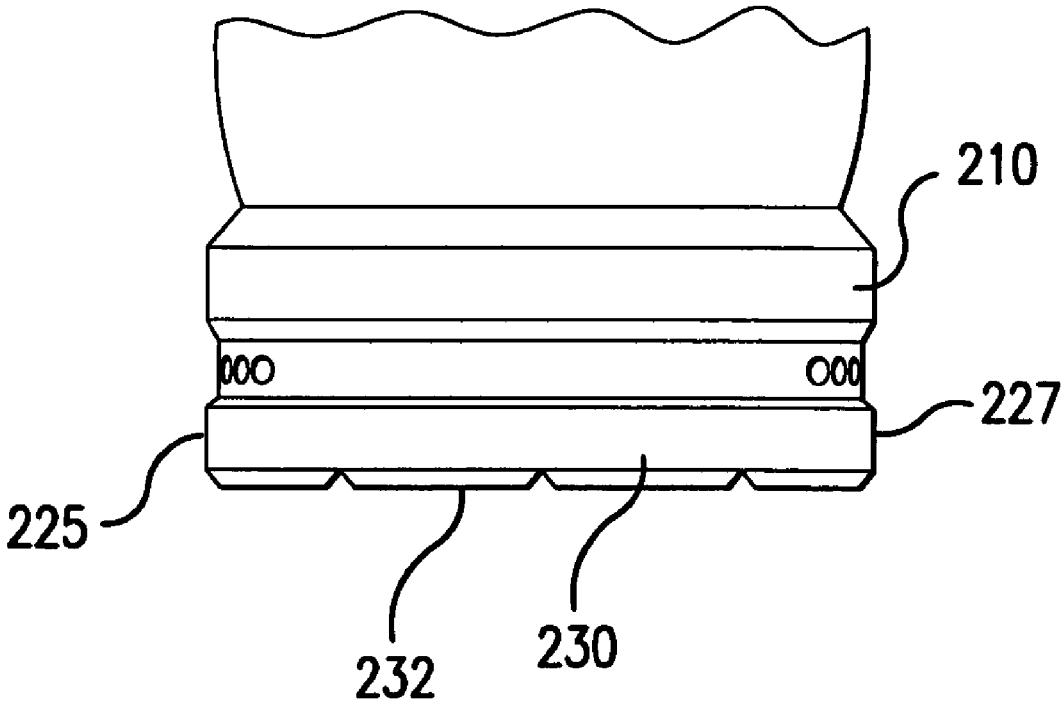
FIG. 2A is a rear heel view of an article of footwear according to a second embodiment of the present invention.

FIG. 2 discloses an alternate embodiment of the present invention. In this embodiment, a transition layer 220 spans the entire sole 203 of a shoe 202 from a heel region 205 to a toe region 207 and, as shown in FIG. 2A, from a medial edge 227 to a lateral edge 225. As with the embodiment shown in FIG. 1, construction of the various layers may be accomplished by any one of the many methods known in the art, such as by injection molding, compression molding, or other suitable methods. Also, it is contemplated that the different layers that compose the various sole designs described herein can be replaced by one single layer of material, in which the density, flexibility, and pliability differs throughout the material, thereby performing the same function of allowing uneven compression and shearing as described herein.

As described above with respect to the embodiment shown in FIG. 1, a first layer 210 is preferably made of a resilient material, such as a high-density foam or rubber. A second layer 230 disposed beneath first layer 210 is also preferably made of a resilient material, preferably the same material as first layer 210, although the other materials described above may also be used.

A transition layer 220 is disposed between first layer 210 and second layer 230. The layers can be co-injection molded, thermally bonded, or adhered with glue. Transition layer 220 is made of a more flexible material than first layer 210 and second layer 230, such as ethyl vinyl acetate (EVA), although many different materials may be used to construct transition layer 220. For example, transition layer 220 may be made of rubber, flexible plastic, low-density foam, or a gel-filled shell. Also, the flexibility of transition layer 220 may be tailored by modifying the thickness, density, and firmness of the material used. In particular, the thickness and density of transition layer 220 may vary lengthwise along shoe 202. For example, transition layer 220 may be thick in heel region 205 to allow for a wide range of motion within transition layer 220, but thin in forefoot region 207 to allow for more limited motion. Similarly, the diameter of holes 222 may be greater in heel region 205 to allow for a wide range of motion within transition layer 220 but smaller in forefoot region 207 to provide more limited motion and vice versa.

Those skilled in the art will appreciate that, as with the embodiment described with respect to FIG. 1, transition layer 220 may be disposed anywhere on or in sole 206 between the foot and the ground.

Referring now to FIG. 2A, deformable holes 222 are similar in type and construction to those described with reference to FIG. 1. Deformable holes 222 are disposed horizontally within transition layer 220 and run from lateral edge 225 to medial edge 227. This arrangement of deformable holes 222 allows for horizontal shearing in a heel-to-toe motion, which is preferred for running shoes.

Figure 2B:
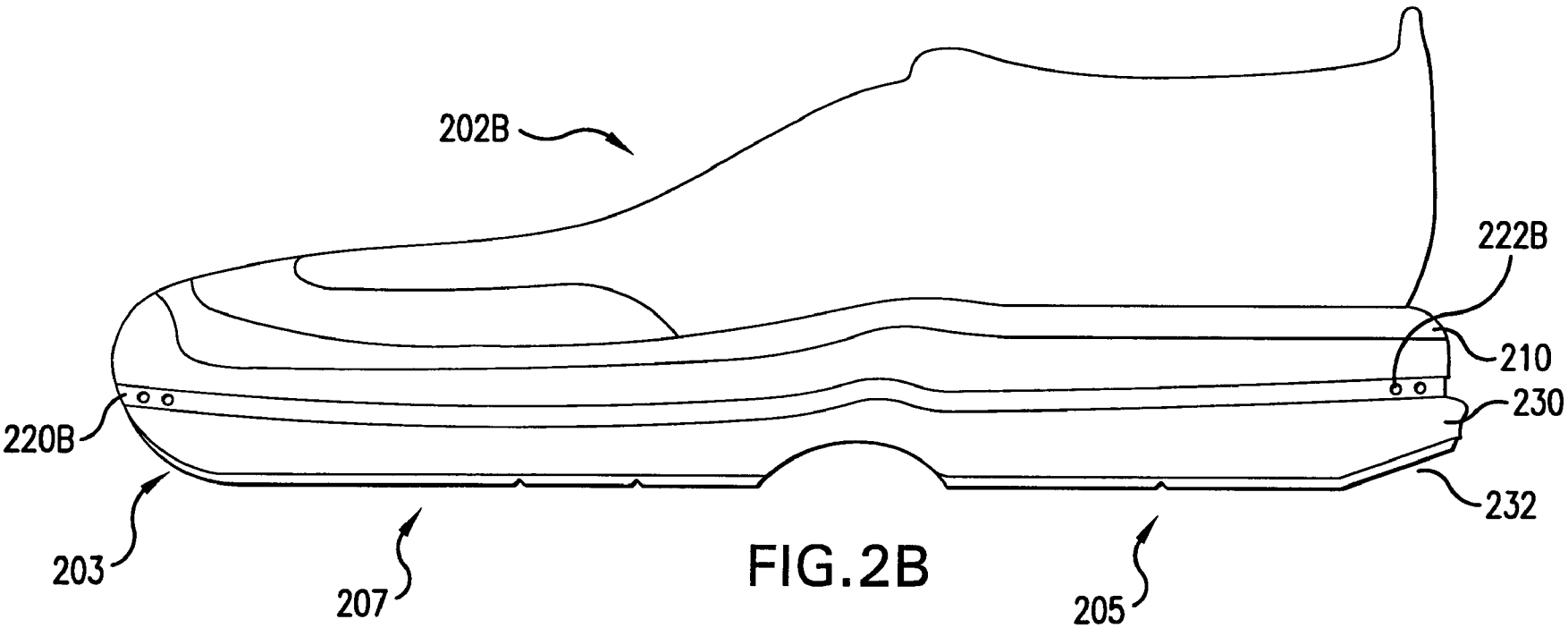
FIG. 2B is a lateral side view of an article of footwear according to the second embodiment, with the deformable holes running longitudinally in the transition layer.
Figure 2C:
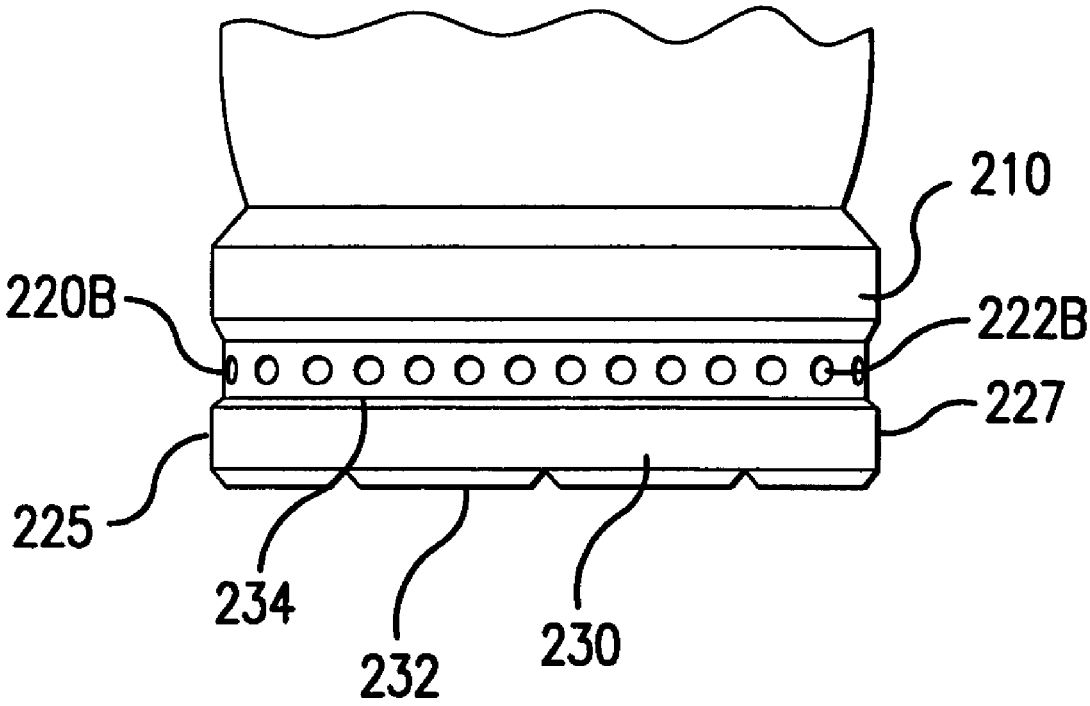
FIG. 2C is a rear heel view of the article of footwear of FIG. 2B.

Alternatively, as is shown in FIGS. 2B and 2C, deformable holes 222B are disposed horizontally within transition layer 220B and run from the back edge of heel region 205 to the front edge of toe region 207. This alternative disposition of deformable holes allows for horizontal shearing in a side-to-side motion, which is preferable for court athletic shoes, such as basketball shoes and tennis shoes, or shoes for neutral runners, i.e., shoes for runners who do not over-pronate or under-pronate. To make this embodiment appropriate for runners with over-pronation problems, additional posting would need to be included, preferably as rigid or semi-rigid plugs placed in deformable holes 222B on medial side 225 so that the plugged holes could distort but not compress. Alternatively, deformable holes 222B on medial side 225 could be eliminated.

Figure 3:
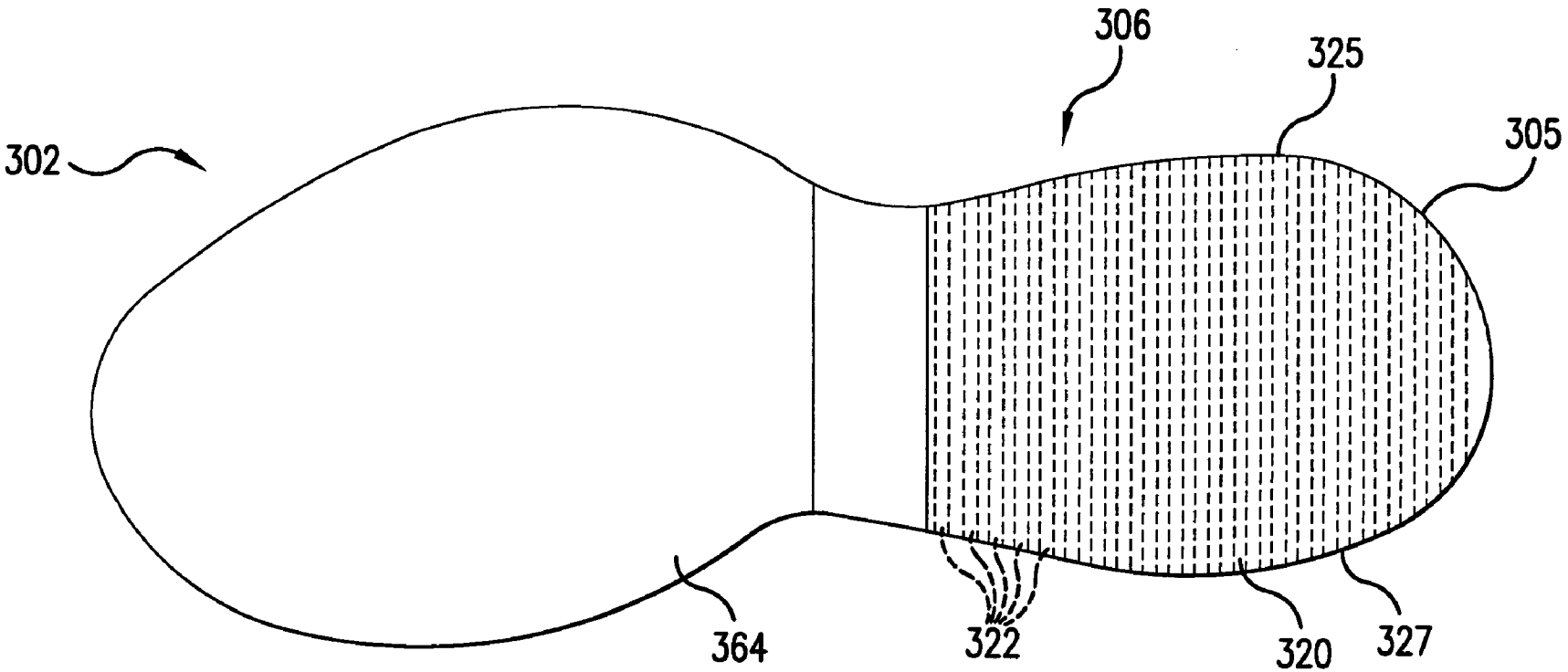
FIG. 3 is a bottom plan view of an article of footwear according to a third embodiment of the present invention.

Another embodiment of the present invention is shown in FIG. 3. A shear sole 306 supports only a heel portion 305 of a shoe 302. Deformable holes 322 are disposed horizontally within a transition layer 320 and run from a lateral edge 325 to a medial edge 327 of shoe 302. A forefoot region 364 of shoe 302 comprises a first layer 310 (not shown), a second layer 350 (not shown in FIG. 3), and outsole 352 (not shown in FIG. 3). As discussed above, modifications can be made, such as the size and orientation of holes 322 and the materials used to construct shear sole 306, or the effects of shear sole 306. Again, those skilled in the art will appreciate that, as with the embodiment described with respect to FIG. 1, transition layer 320 may be disposed anywhere on or in sole 306 between the foot and the ground.

Figure 4:
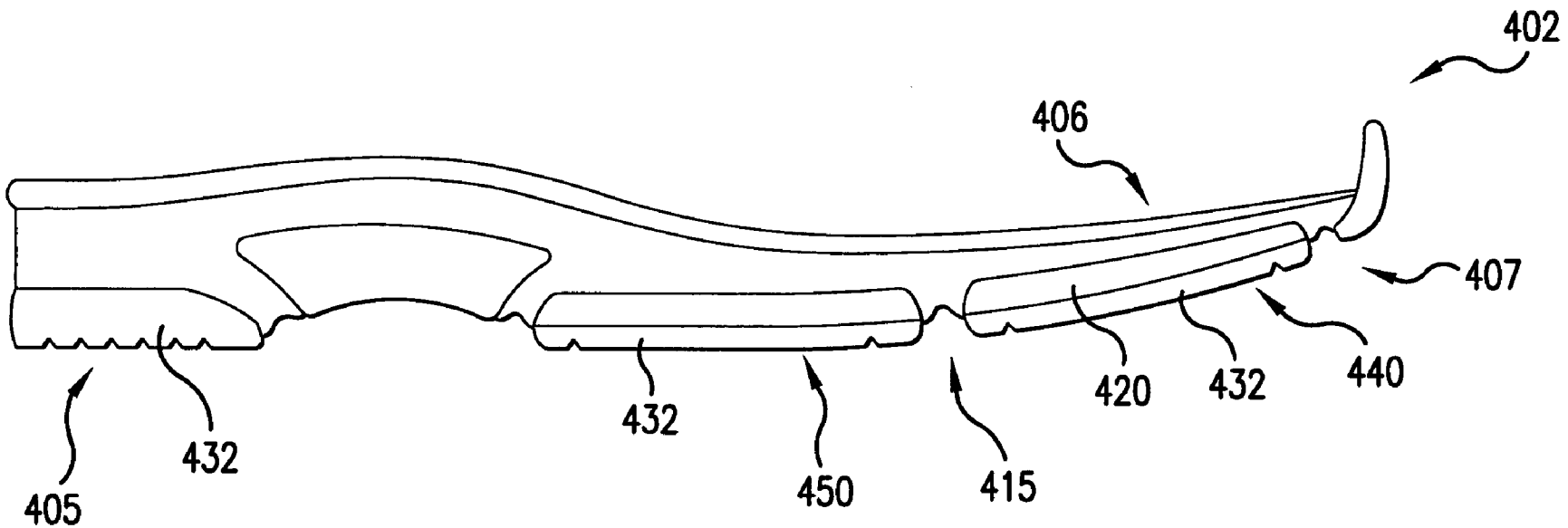
FIG. 4 is a medial side view of an article of footwear according to a fourth embodiment of the present invention.
Figure 5:
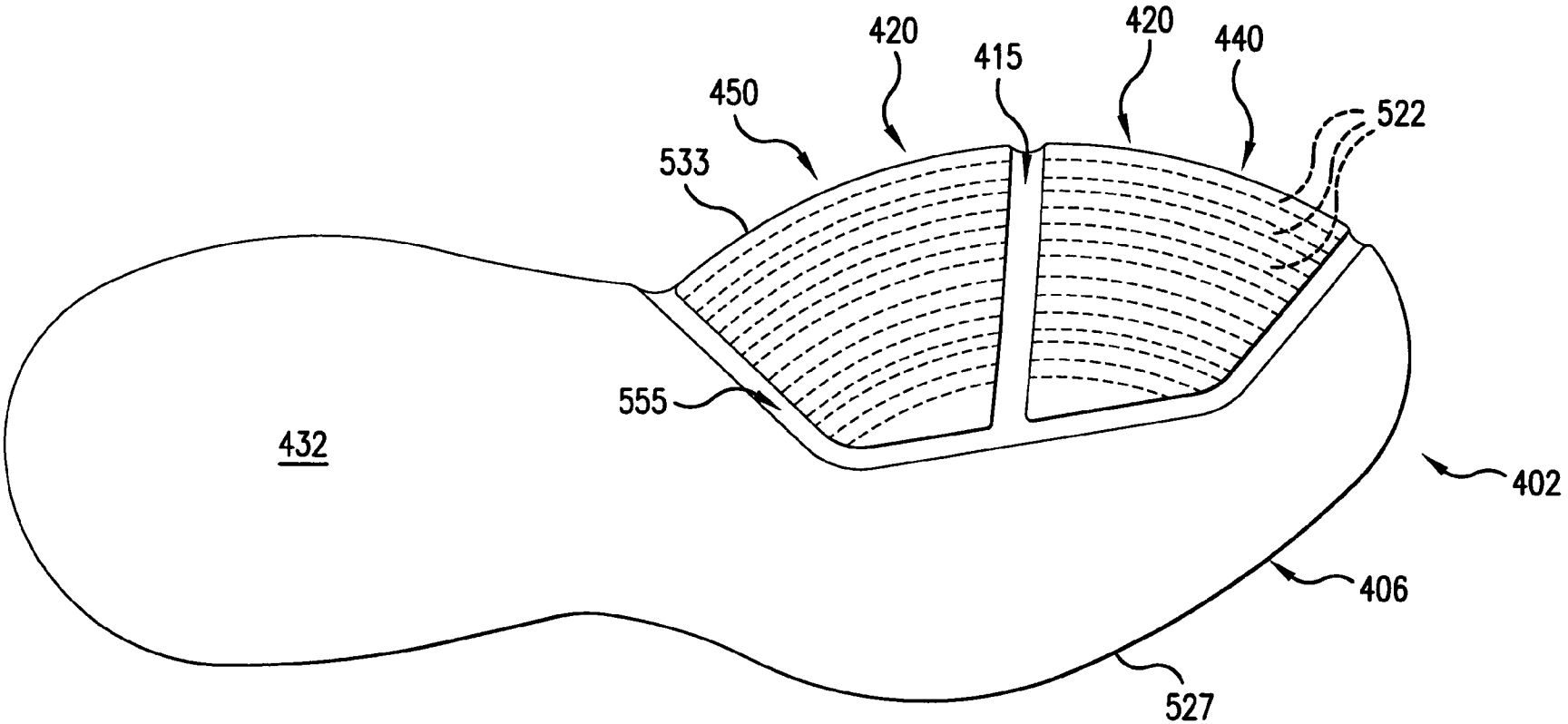
FIG. 5 is a bottom plan view of an article of footwear according to a fourth embodiment of the present invention.

Referring now to FIGS. 4 and 5, yet another embodiment of the present invention is disclosed. A sole 406 includes a first layer 410 and an outsole 432 that generally run from a heel 405 to a toe 407 and from a medial edge 527 to a lateral edge 533 of a shoe 402. A transition layer 420 is disposed between first layer 410 and outsole 432 in two spaced-apart sections 440 and 450 located in the medial forefront region of sole 406. Transition layer 420 is made of a more-flexible material than that of first layer 410 and outsole 432 and contains horizontally disposed, deformable holes 522. A gap 415 is formed between sections 440 and 450 to allow for relative motion of the sections and for forefoot flexibility of sole 406. Again, those skilled in the art will appreciate that, as with the embodiment described with respect to FIG. 1, transition layer 420 may be disposed anywhere on or in sole 406 between the foot and the ground.

Referring now to FIG. 5, outsole 432 is removed from spaced-apart sections 440 and 450 to expose transition layer 420. Deformable holes 522 are disposed horizontally in transition layer 420 and run in a heel-to-toe direction of shoe 402. Channel 555, separates medial forefoot sections 440 and 450 from the remainder of outsole 432. Transition layer 420 is included in sections 440 and 450 and extends towards the center of sole 406 to channel 555. Channel 555 allows sections 440 and 450 to move independently of the remainder of sole 406. Outsole 432 may or may not also be divided by channel 555, depending upon the desired amount of relative motion.

Figure 6:
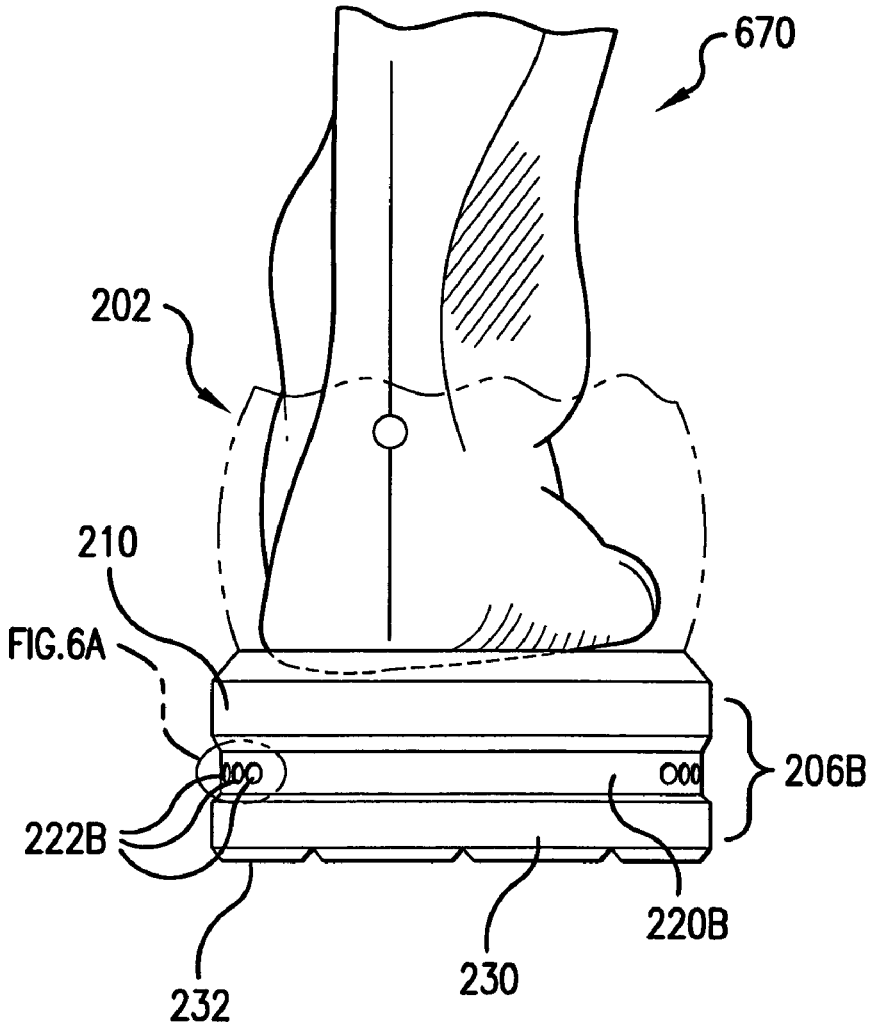
FIG. 6 is a rear heel view of the footwear of FIG. 2C under static conditions.
Figure 6A:
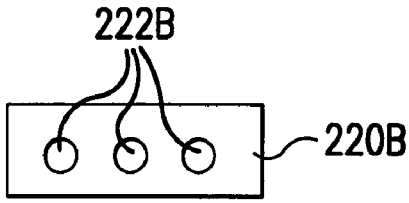
FIG. 6A is an enlarged view of the section of the transition layer of FIG. 6 enclosed by circle A.
Figure 6B:
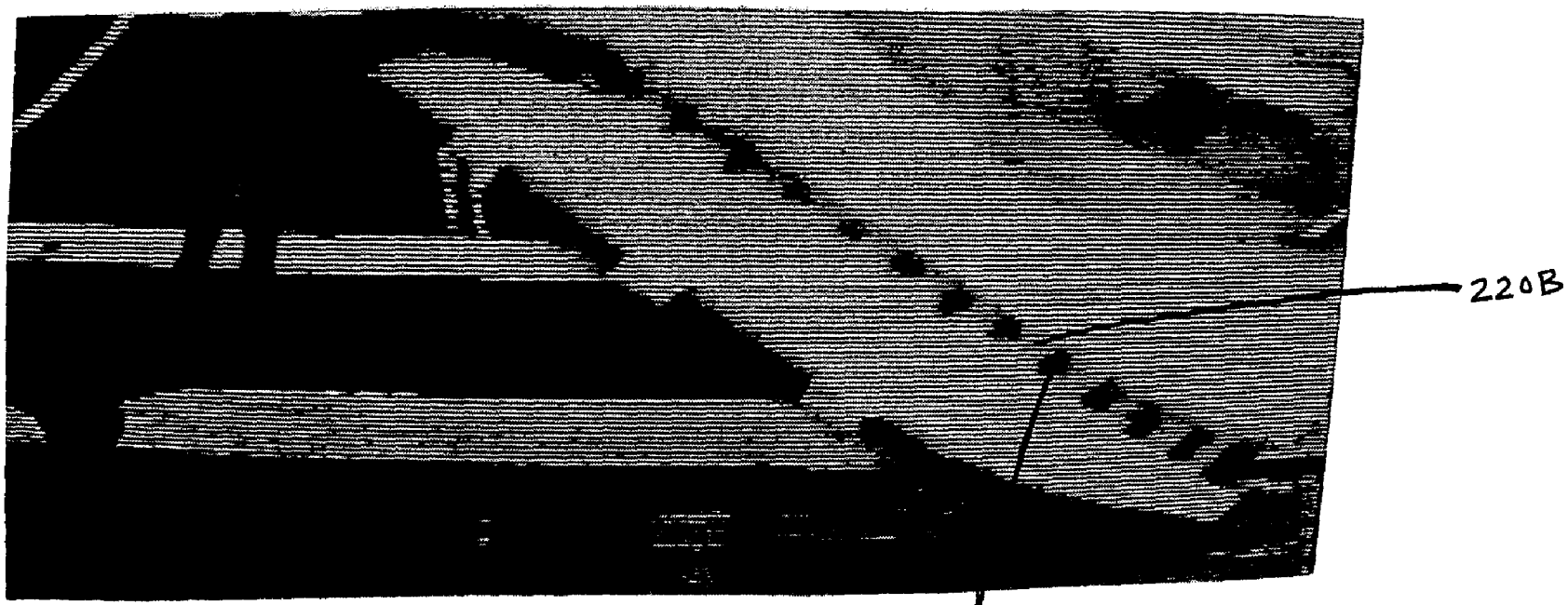
FIG. 6B is a motion capture photograph of an article of footwear according to the embodiment of FIG. 2C just prior to the heelstrike.

FIGS. 6–9 depict the present invention as described with reference to FIGS. 2B and 2C under various wearing conditions. FIG. 6 shows shoe 202B with shear sole 206B on a foot 670 as it would appear in a stationary position. When the wearer of shoe 202B is not in motion, transition layer 220B retains its shape, as do deformable holes 222B. FIG. 6A, an enlarged view of a section of transition layer 220B, shows holes 222B as circular holes of generally uniform diameter. It will be understood by one skilled in the art that, depending on the material, density, and thickness of transition layer 220B, the location, size, and number of deformable holes 222B, as well as the weight of the wearer, transition layer 220B may deform in a stationary position. FIG. 6B shows a motion capture photograph of transition layer 220B just prior to the heelstrike. Deformable holes 222B are uniformly circular in shape.

Figure 7:
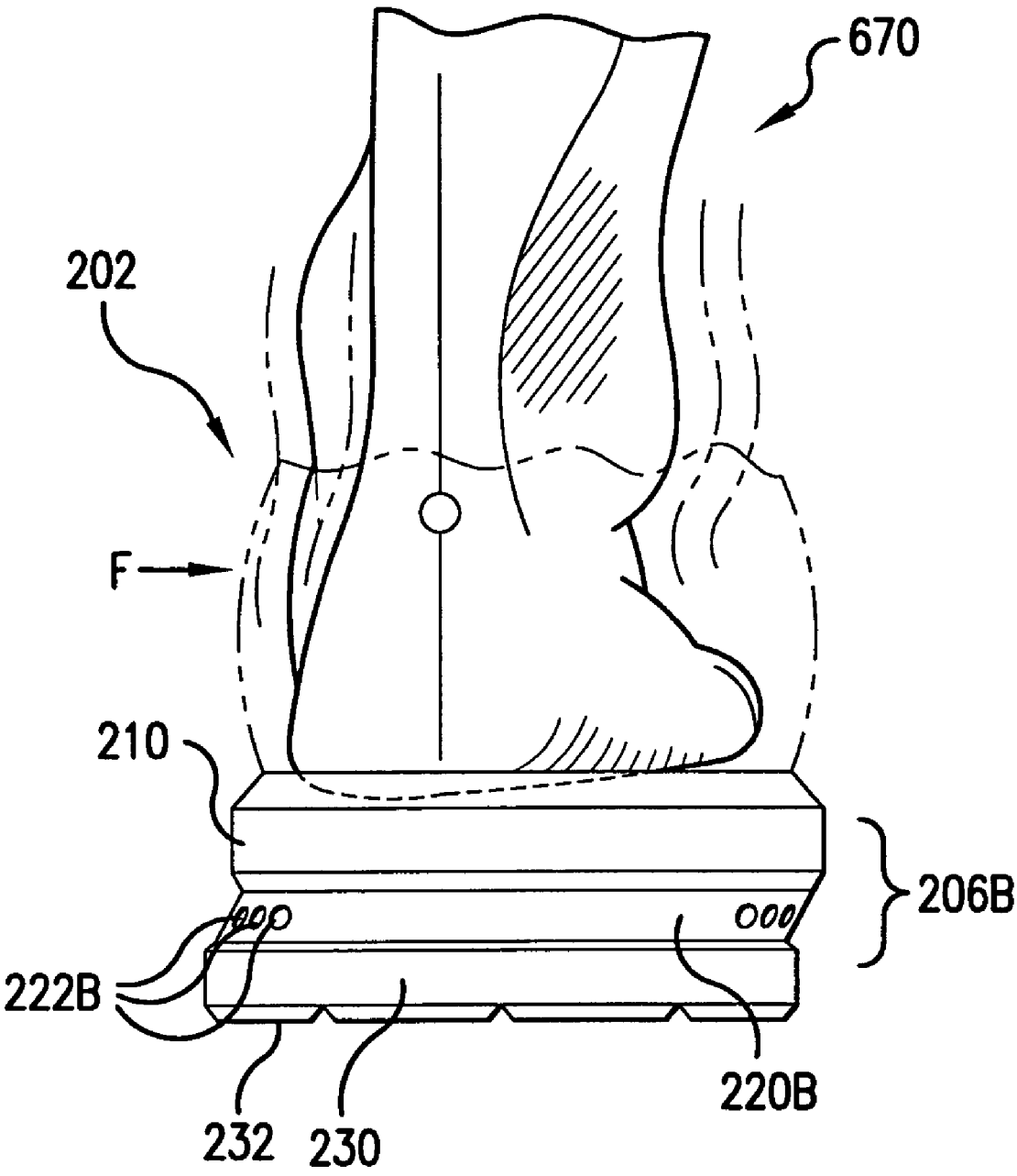
FIG. 7 is a rear heel view of the footwear of FIG. 2C as a wearer stops lateral motion.

FIG. 7 discloses shoe 202B as it would appear when stopping lateral motion of the wearer. As outsole 232 comes into contact with the ground, the natural tendency of a laterally-moving foot 670 is to continue in a lateral direction. Due to the relative flexibility of transition layer 220B, when outsole 232 is firmly planted on the ground and foot 670 is moving in a lateral direction, transition layer 220B shears in the lateral direction as a result of a force F. This horizontal shear acts as a lateral cushion and may prevent the foot 670 from rolling or sustaining an injury as a result of the this activity.

Figure 8:
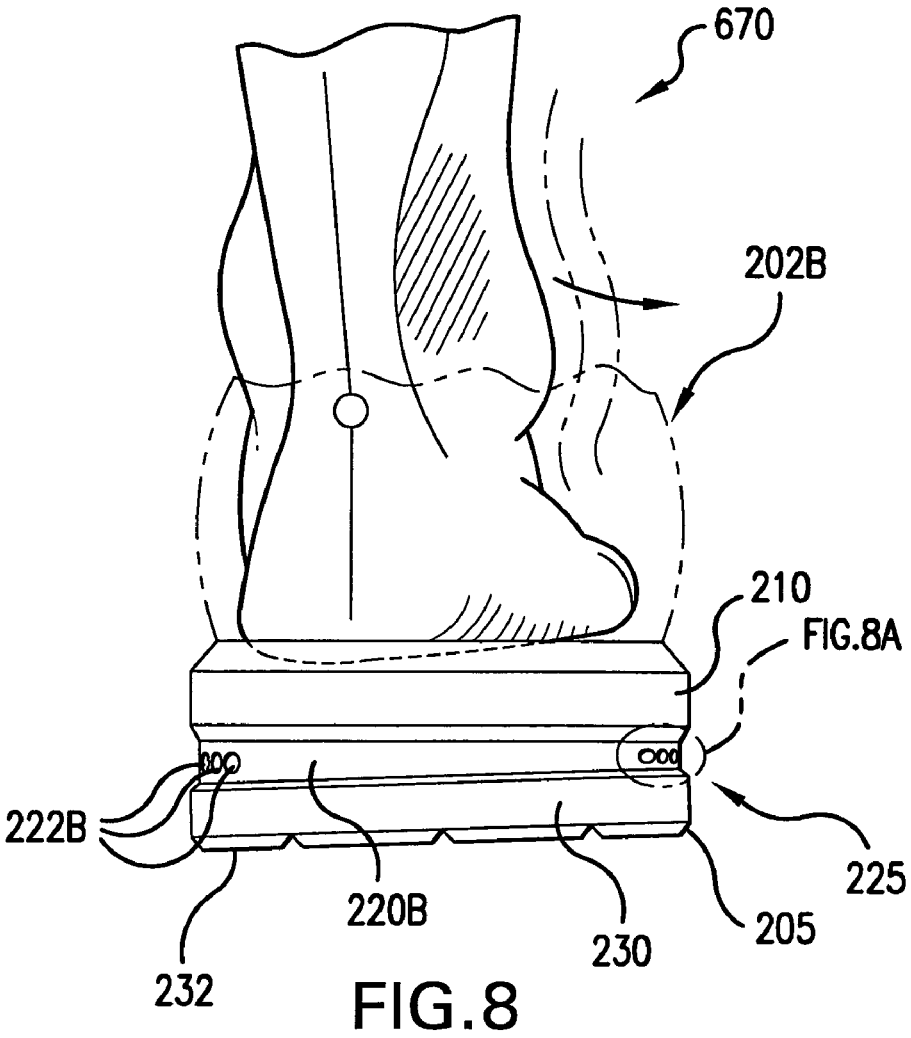
FIG. 8 is a rear heel view of the footwear of FIG. 2C subjected to a normal footstrike.
Figure 8A:
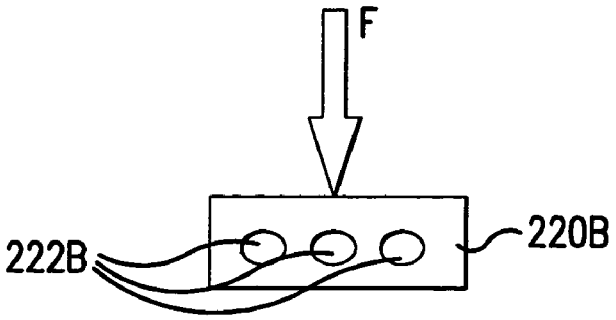
FIG. 8A is an enlarged view of the section of the transition layer of FIG. 8 enclosed by circle B.
Figure 8B:
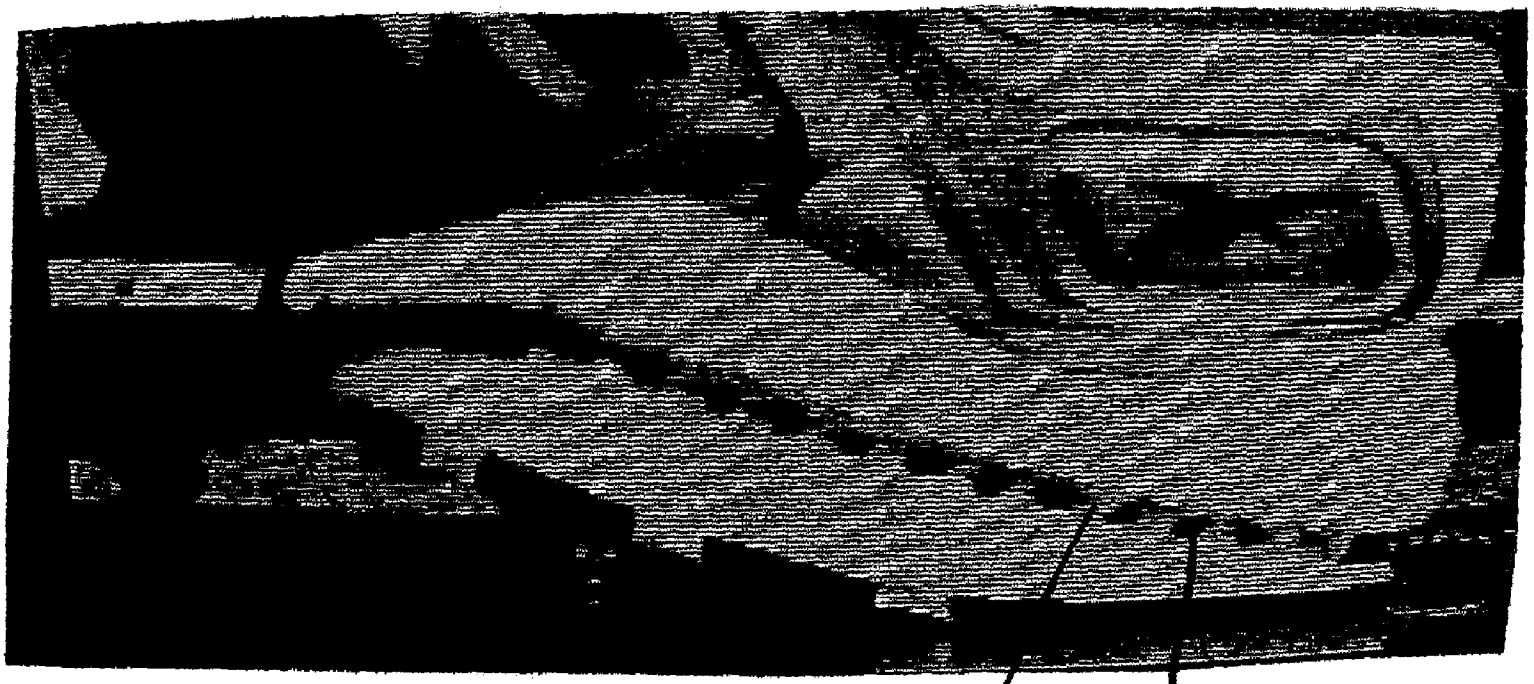
FIG. 8B is a motion capture photograph of an article of footwear according to the embodiment of FIG. 2C during the heelstrike.
Figure 8C:
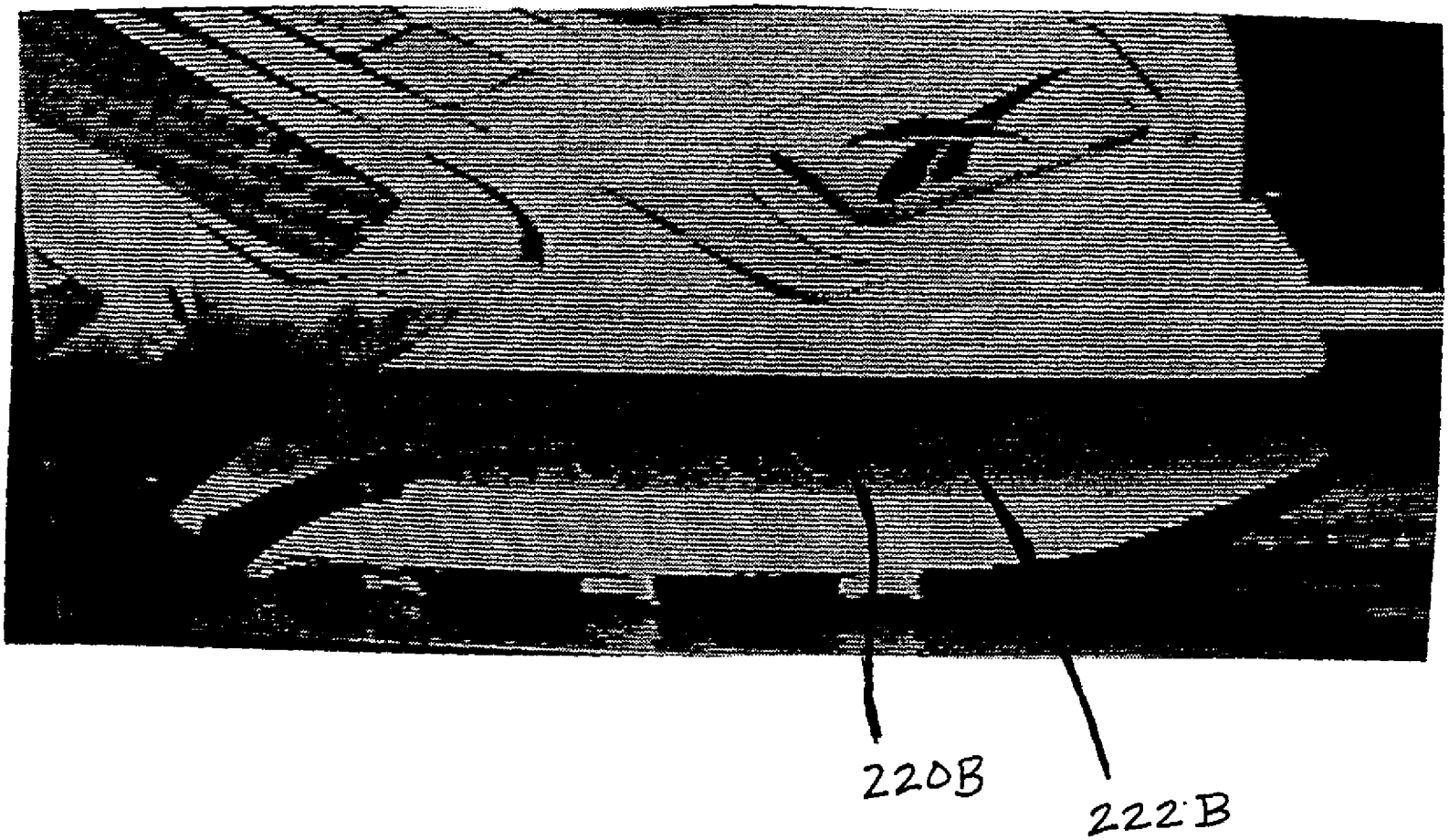
FIG. 8C is a motion capture photograph of an article of footwear according to the embodiment of FIG. 2C subsequent to the heelstrike.

FIG. 8 depicts a normal right foot strike during walking, or running, normally a less extreme situation than the abrupt cessation of lateral motion. Again, this feature prevents a possible injury to the wearer. Typically, for most runners, the lateral side of heel 205 strikes the ground first, with foot 670 slightly pronated. As heel 205 contacts the ground, transition layer 220B compresses on lateral side 225 of heel 205, reducing the force created as a result of the uneven foot strike. FIG. 8A, an enlarged view of a section of transition layer 220B as deformed by the heelstrike, shows the thickness of transition layer 220B compressed by force F. Accordingly, deformable holes 222B have been flattened from a circular configuration into a generally elliptical shape. FIG. 8B shows a motion capture photograph of transition layer 220B during the heelstrike. Deformable holes 222B have been flattened in the region of the impact of the heelstrike. FIG. 8C shows a motion capture photograph of transition layer 220B subsequent to the heelstrike. Deformable holes 222B in the region of the heelstrike have returned to their pre-impact shape.

Figure 9:
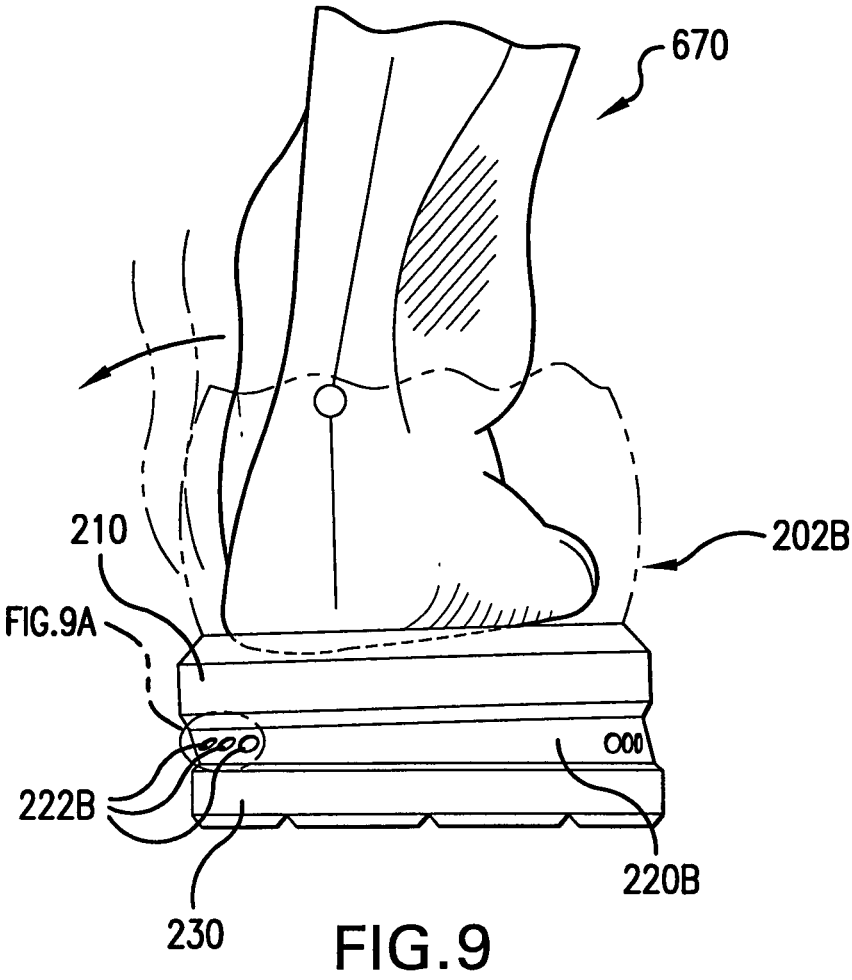
FIG. 9 is a rear heel view of the footwear of FIG. 2C depicting the shoe as the wearer changes direction.
Figure 9A:
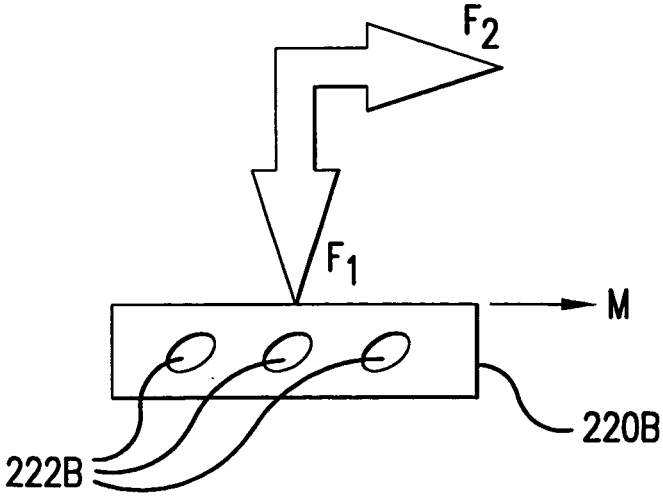
FIG. 9A is an enlarged view of the section of the transition layer of FIG. 9 enclosed by circle C.

FIG. 9 discloses a further view of shoe 202B as it would appear when the wearer rapidly changes direction. A footstrike in this situation creates both strong downward and lateral forces. Under these conditions, transition layer 220B allows for shear between the layers and compresses vertically, providing cushioning for the downward force on foot 670. FIG. 9A, an enlarged view of a section of transition layer 220B as deformed by this direction-changing heelstrike, shows that the thickness of transition layer 220B has been compressed by force F1. Additionally, shearing force F2 causes the upper surface of transition layer 220B to deform relative to the lower surface of transition layer 220B, as indicated by arrow M. This relative deformation is due to the upper layers moving with the foot and the lower layer being held stationary due to friction with the ground. As a result of forces F1 and F2, deformable holes 222B have been altered in shape from the circular form as shown in FIG. 6 to a flatter, skewed elliptical form.

The transition layer of the present invention is not limited in structure to the pliable layer in the embodiments described above. Various transition layer structures that permit controlled relative movement between the other layers of a sole could also be used. Another such structure is now described with reference to FIG. 10. A shoe 1002 has a sole 1003 with a transition layer 1020 disposed in a forefront region 1007. A lateral shear assembly 1021 comprises transition layer 1020 and is disposed between a first layer 1010 and an outsole 1052. Alternatively, assembly 1021 may be disposed between first layer 1010 and a second layer 1030 (not shown in FIG. 10). Transition layer 1020 preferably does not comprise the entirety of forefront 1007. The remainder of sole 1003 in forefront 1007 comprises, for example, first layer 1010, second layer 1030, and outsole 1052 although a single layer or various other configurations. Further, not shown in FIG. 10, transition layer 1020 with lateral shear assembly 1021 could be disposed in a heel region 1005 of shoe 1002 instead of or in addition to transition layer 1020 in forefront region 1007.

Figure 11:
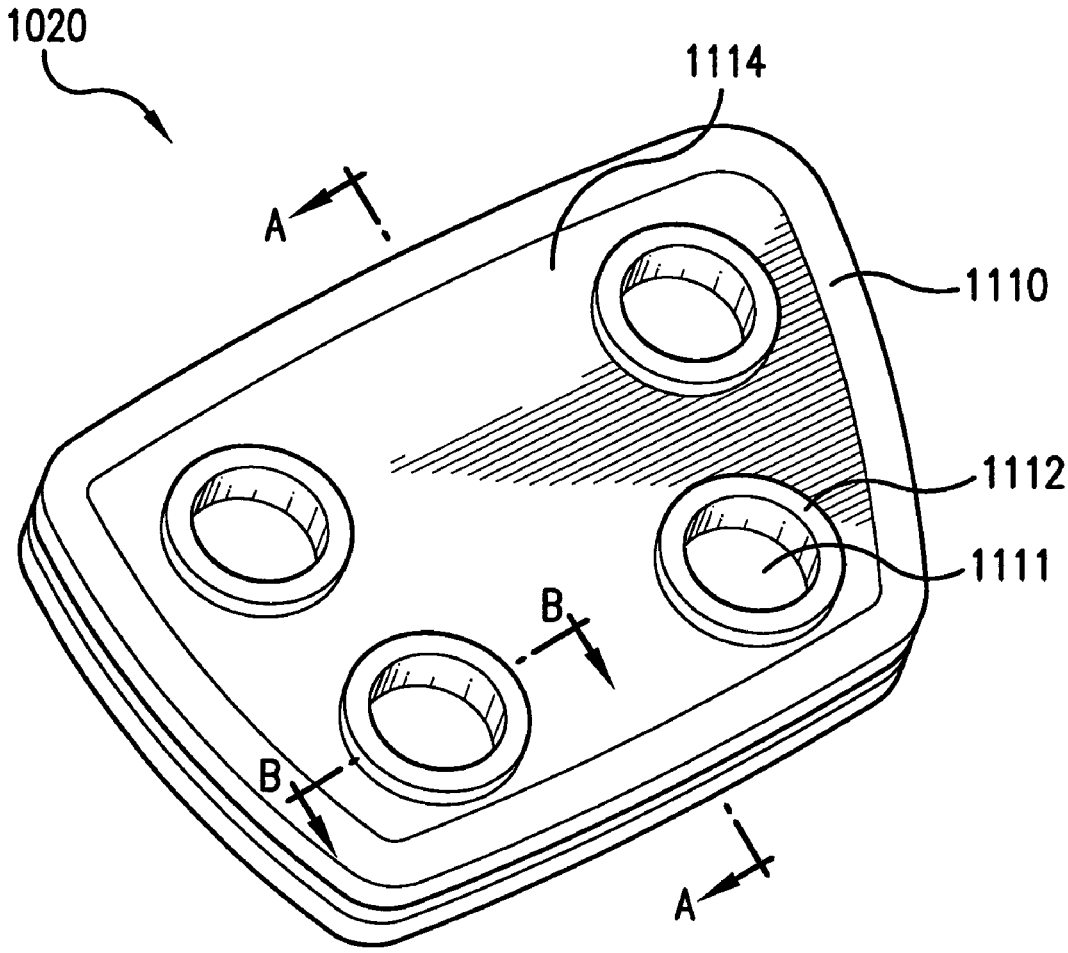
FIG. 11 is a perspective view of a transition layer according to an alternate embodiment of the present invention.

Lateral shear assembly 1021 is now described in further detail with reference to FIGS. 11 and 12. Assembly 1021 includes an upper plate 1114 and a lower plate 1216 with coordinating holes 1111 disposed in plates 1114, 1216. Holes 1111 may be disposed in plates 1114 and 1216 in various configurations, but, as shown in FIG. 11, there are preferably four holes, one located generally in each corner of plates 1114 and 1216, placed inward from the edges of plates 1114 and 1216. Plates 1114, 1216 are made of a rigid material, preferably nylon, but also other thermoplastics, metals, or composite materials.

Dimples 1218 preferably cover the contact surface of upper plate, while the contact surface of lower plate 1216 is smooth. This reduces the amount of surface area contact, and, consequently the friction, between plates 1114 and 1216. This reduction of friction allows for smoother relative motion of plates 1114 and 1216. Alternatively, however, both contact surfaces may be smooth, dimpled, lightly textured such as by sandblasting, or coated on their surfaces with a low coefficient of friction coating, such as Teflon®.

Upper plate 1114 and lower plate 1216 are of a uniform size and shape. As shown in FIG. 11, plate 1114 is an irregular quadrangle, so shaped as to conform to the typical contours of a shoe sole forefront; however any shape may be used, such as circular, rectangular, square, or triangular. While the exact dimensions of plates 1114, 1216 depend upon the size of the shoe into which assembly 1021 is to be inserted, plates 1114, 1216 are sized so as not to constitute the entire forefront region.

Upper plate 1114 and lower plate 1216 are stacked so that coordinating holes 1111 align and dimples 1218 abut against the smooth upper surface of plate 1216. An optional sidewall cover 1110 wraps around the circumference of assembly 1021 to prevent contaminants from lodging between plates 1114, 1216, i.e., to keep debris from interfering with the relative motion of plates 1114, 1216. Sidewall cover 1110 may be a single piece which is stretched and pulled onto assembly 1021 like a rubber band, or may be multiple pieces, such as two, fitted together in the final stages of production to facilitate production of assembly 1021. Sidewall cover 1110 may be made of any durable pliable material, such as cast polyurethane, rubber, or injection-molded PU. Sidewall cover 1110 must be pliable enough so as not to inhibit the relative motion of the plates, but must also fit tightly around the circumference of assembly 1021, being held in place by geometry and friction. Alternatively, sidewall cover 1110 may be adhered to the outward-facing surfaces of plates 1114, 1216, such as by gluing, cementing, or welding.

Grommets 1112 are preferably spool-shaped with a central bore and disposed within holes so that top and bottom "caps" of the spool 1324 rest on the exterior surfaces of plates 1114 and 1216. Alternatively, grommets 1112 maybe solid cylinders, lack caps, or have a non-cylindrical body, so long as grommets 1112 fit snugly into holes 1111. Grommets 1112 not only join upper plate 1114 and lower plate 1216 but also serve as the shearing constraints for assembly 1021. Grommets 1112 fit snugly into holes 1111 but are made of a material that is more pliable than that of plates 1114, 1216, preferably TPU, but also rubber, silicone, neoprene, or other similar materials. While four grommets 1112 and holes 1111 are shown, one skilled in the art will recognize that this number may be altered in order to affect the shearing constraint and comfort properties of assembly 1021.

While the main purpose of sidewall cover 1110 is to prevent debris from clogging assembly 1021 and inhibiting the smooth relative motion of plates 1114, 1216, sidewall cover 1110 can also function as a horizontal shear constraint. In one embodiment, sidewall cover 1110 acts as a supplemental horizontal shear constraint to grommets 1112. In this embodiment, sidewall cover 1110 is made of a slightly stiffer material than when sidewall cover is merely an impediment to debris. Also in this embodiment, sidewall cover 1110 is preferably adhered to the outward-facing surfaces of plates 1114, 1216 as described above, such as by gluing or welding. This fixing of sidewall cover 1110 increases the structural stability thereof. Also, if grommets 1112 are of a configuration lacking caps or other flanges, sidewall cover 1110 can hold plates 1114, 1216 together, i.e., maintain contact between plates 1114, 1216.

In an alternate embodiment, grommets 1112 are preferably eliminated from the design, and sidewall cover 1110 acts as the horizontal shear constraint. In this embodiment, the material of sidewall cover 1110 would be similar to that of grommets 1112, i.e., stiffer than if sidewall cover were simply acting as a barrier to the introduction of impurities. An injection-molded elastomer or similar material is appropriate in this embodiment. Also in this embodiment, sidewall cover 1110 is preferably adhered to the outward-facing surfaces of plates 1114, 1216 as described above, such as by gluing or welding.

In yet another alternate embodiment, assembly 1021 may be sandwiched in or embedded in an outsole construction. In such a case both grommets 1112 and sidewall cover 1110 could be eliminated. The material of the outsole itself would act as both horizontal shear constraint and plate connector.

Figure 10:
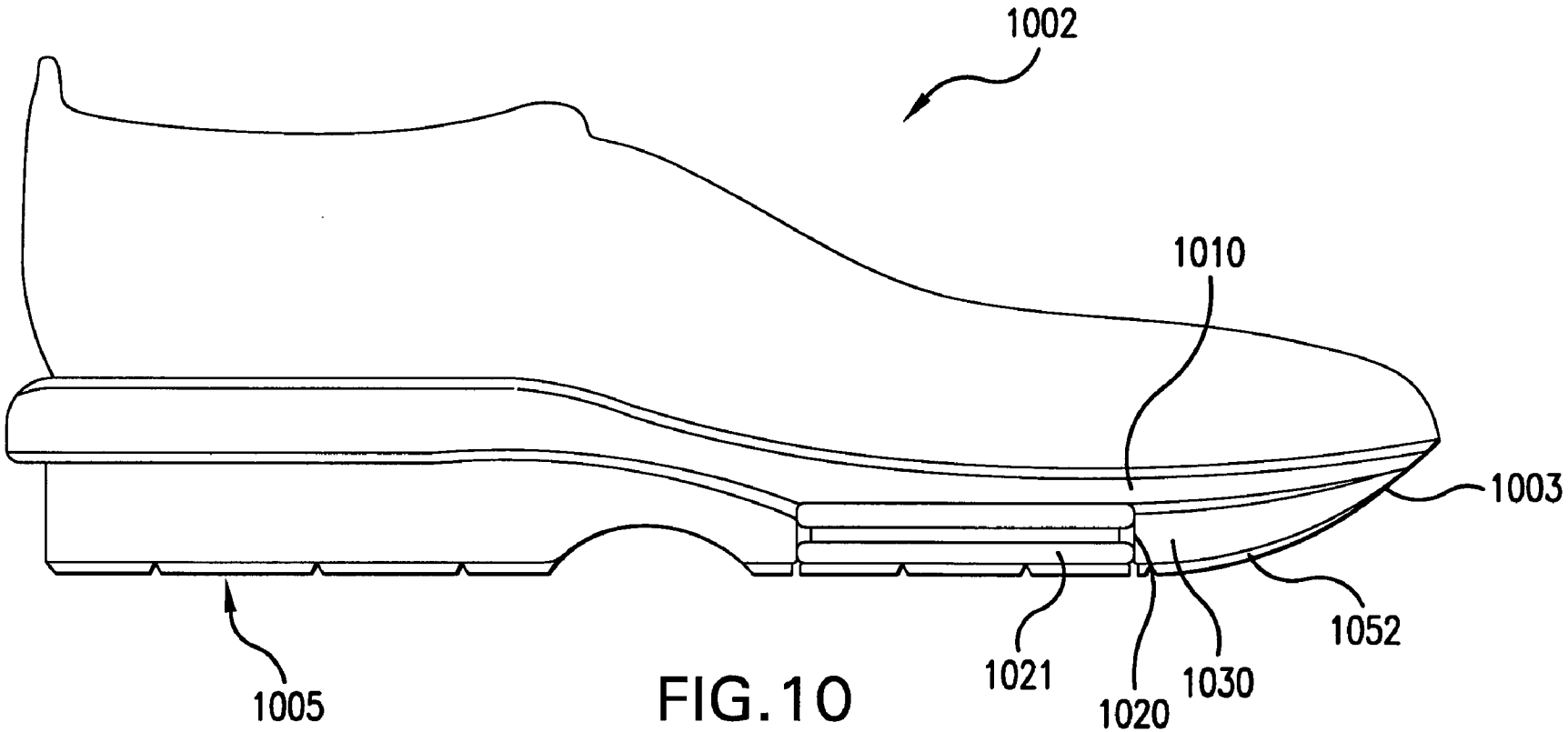
FIG. 10 is a lateral side view of an article of footwear according an alternate embodiment of the present invention.
Figure 12:
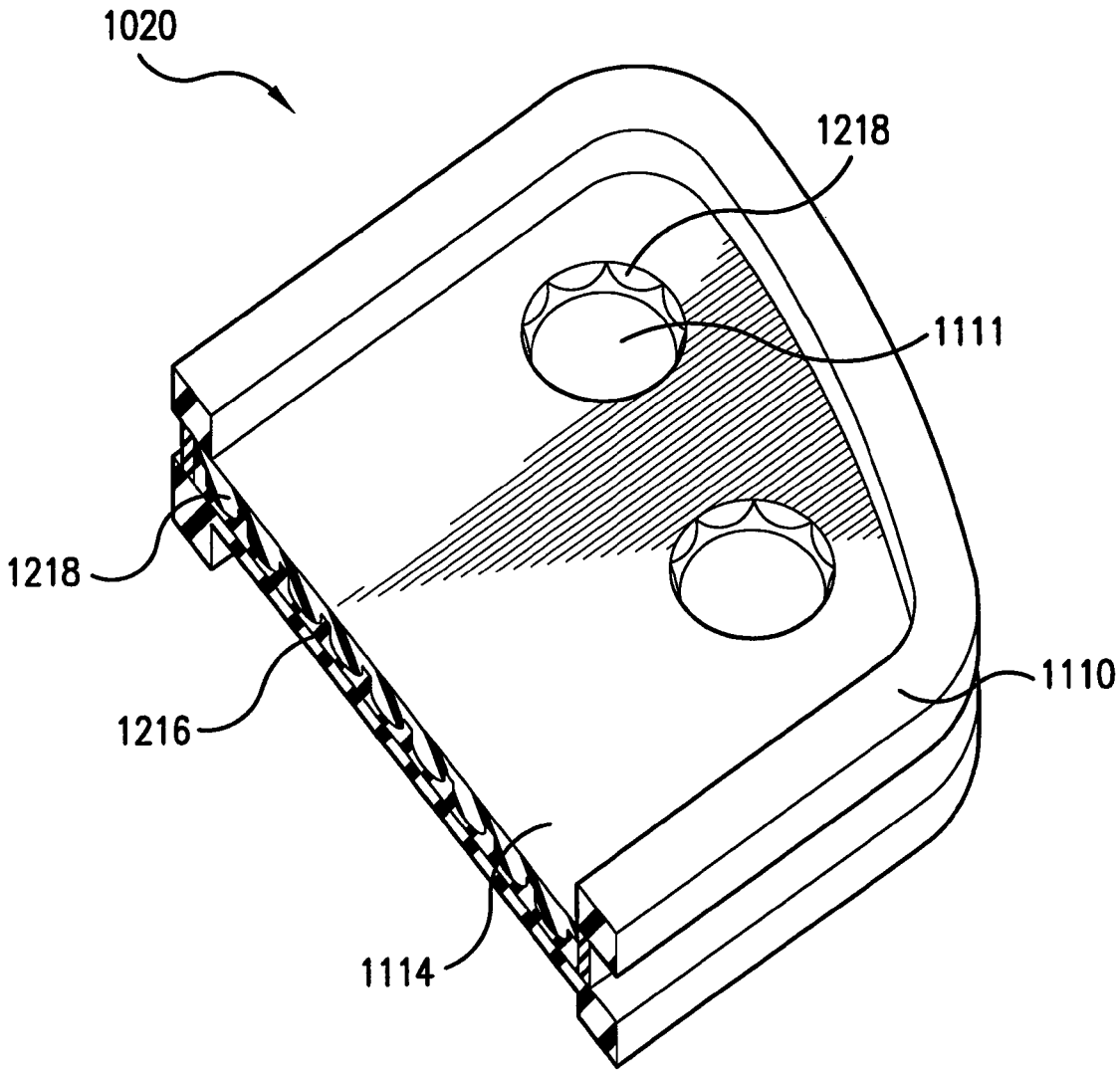
FIG. 12 is a cross-sectional view of the transition layer of FIG. 11, taken along line A—A.
Figure 13A:
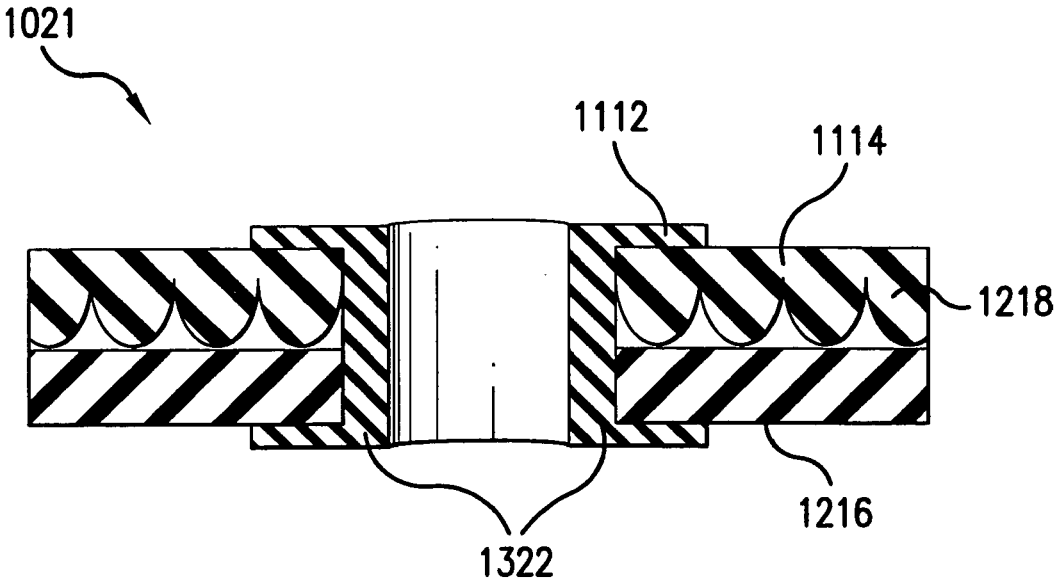
FIG. 13A is an enlarged cross-sectional view of the transition layer of FIG. 11, taken along line B—B.
Figure 13B:
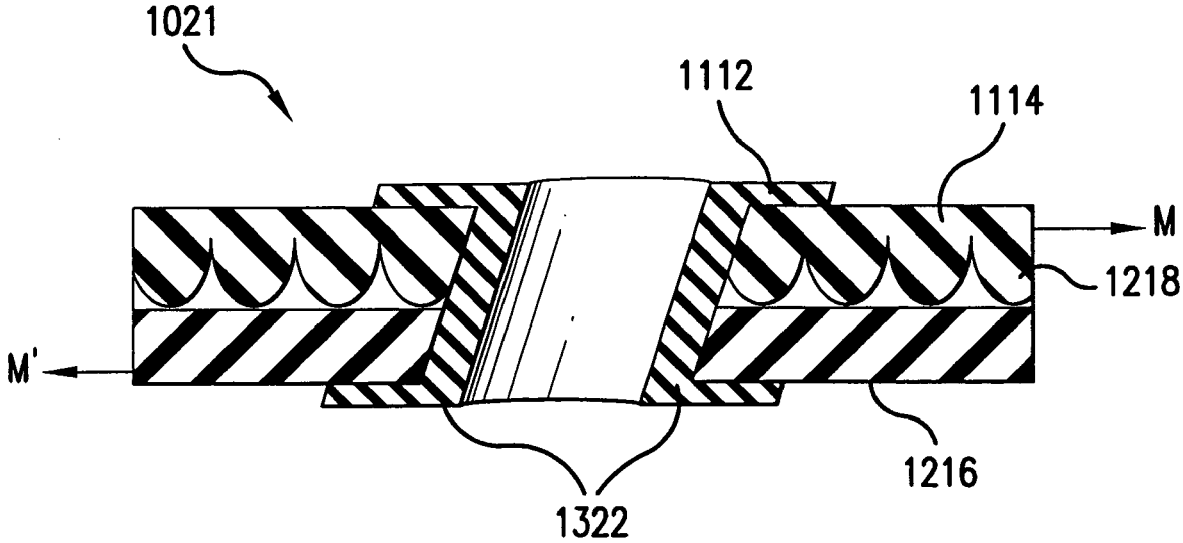
FIG. 13B is an enlarged cross-sectional view of the transition layer of FIG. 11, taken along line B—B, subjected to a horizontal shear force.

FIGS. 13A and 13B depict the functioning of assembly 1021 according to the embodiment thereof as shown in FIGS. 10–12. FIG. 13A shows assembly 1021 under static conditions. Grommet 1112 joins upper plate 1114 and lower plate 1216. Grommet 1112 is disposed within hole 1111. Grommet sidewalls 1322 are generally perpendicular with respect to plates 1114, 1216.

When shearing forces are applied to assembly 1021, grommets 1112 give slightly, allowing for relative motion between upper plate 1114 and lower plate 1216. FIG. 13B shows the distortion of grommet 1112 and relative motion between upper plate 1114 and lower plate 1216. Grommet sidewalls 1322 deform slightly, allowing relative motion of upper plate 1114 and lower plate 1216. The deformation of sidewalls 1322 need not be linear as shown in FIG. 13B, as sidewalls 1322 may take on other shapes, such as sinusoidal or stepped. With respect to each other, upper plate 1114 moves in direction M and lower plate 1216 moves in direction M'. Alternatively, one of the plates, most often lower plate 1216, remains stationary and the other plate, upper plate 1114, moves with respect to lower plate 1216. As described above, dimples 1218 reduce the friction between plates 1114, 1216 so that the relative motion between upper plate 1114 and lower plate 1216 is smooth.

As the deformation of sidewalls 1322 of grommet 1112 constrains the relative movement of plates 1114, 1216, altering the properties of grommet 1112 will affect the performance of assembly 1021. For example, if a stiffer material is used to make grommet 1112, or if sidewalls 1322 are made thicker, sidewalls 1322 will deform to a lesser degree and the relative motion of plates 1114, 1216 will be reduced. Alternatively, if a softer material is used to make grommet 1112, or if sidewalls 1322 are made thinner, sidewalls 1322 will deform to a greater degree and the relative motion of plates 1114, 1216 will be increased.

While this invention has been particularly shown and described with reference to preferred embodiments thereof, it will be understood by those skilled in the art that various changes in form and details may be made therein without departing from the spirit and scope of the invention.

What is claimed is:

1. A sole for an article of footwear, comprising:

a first layer;

a second layer; and a transition layer disposed between at least a portion of said first layer and said second layer and allowing relative horizontal motion between at least a portion of said first layer and at least a portion of said second layer, wherein said transition layer comprises a shear plate assembly, said shear plate assembly comprising an upper plate made of a rigid material, said upper plate having a first contact surface, a lower plate made of a rigid material, said lower plate having a second contact surface, wherein said upper plate and said lower plate are stacked so that said first contact surface abuts against said second contact surface and said upper plate and said lower plate are joined together to allow relative motion therebetween, wherein said upper plate has at least one hole disposed therein, said lower plate has at least one coordinating hole disposed therein, and said holes are aligned so that a grommet made of a less rigid material than that of said upper plate and said lower plate may be disposed within said holes to join said upper plate and said lower plate.

2. The sole for an article of footwear according to claim 1 wherein deformation of said grommet allows for relative motion between said upper plate and said lower plate.

3. The sole for an article of footwear according to claim 1 wherein said first contact surface is dimpled and said second contact surface is smooth.

4. The sole for an article of footwear according to claim 1 wherein both of said contact surfaces are smooth.

5. The sole for an article of footwear according to claim 1 wherein both of said contact surfaces are dimpled.

6. The sole for an article of footwear according to claim 1 wherein said shear plate assembly is disposed in only a forefront section of said sole.

7. The sole for an article of footwear according to claim 1 wherein said shear plate assembly is disposed in only a heel section of said sole.

8. The sole for an article of footwear according to claim 1 wherein a first shear plate assembly is disposed in a forefront section of said sole and a second shear plate assembly is disposed in a heel section of said sole.

9. A sole for an article of footwear, comprising:

a first layer;

a second layer; and a transition layer disposed between at least a portion of said first layer and said second layer and allowing relative horizontal motion between at least a portion of said first layer and at least a portion of said second layer, wherein said transition layer comprises a shear plate assembly, said shear plate assembly comprising an upper plate made of a rigid material, said upper plate having a first contact surface, a lower plate made of a rigid material, said lower plate having a second contact surface, wherein said upper plate and said lower plate are stacked so that said first contact surface abuts against said second contact surface and said upper plate and said lower plate are joined together to allow relative motion therebetween, wherein said shear plate assembly includes at least one sidewall covering wrapped around a circumference of an outside edge of said joined upper plate and said lower plate, said sidewall covering enclosing an opening between said upper plate and said lower plate.

10. The sole for an article of footwear according to claim 9 wherein an upper portion of said sidewall covering is fixedly attached to said upper plate.

11. The sole for an article of footwear according to claim 9 wherein a portion of said sidewall covering is fixedly attached to said lower plate.

12. The sole for an article of footwear according to claim 9 wherein deformation of said sidewall covering allows for relative motion between said upper plate and said lower plate.

13. A sole for an article of footwear, comprising:

a first layer;

a second layer; and a transition layer disposed between at least a portion of said first layer and said second layer and allowing relative horizontal motion between at least a portion of said first layer and at least a portion of said second layer, wherein said transition layer comprises a shear plate assembly, said shear plate assembly comprising an upper plate made of a rigid material, said upper plate having a first contact surface, a lower plate made of a rigid material, said lower plate having a second contact surface, wherein said upper plate and said lower plate are stacked so that said first contact surface abuts against said second contact surface and said upper plate and said lower plate are joined together to allow relative motion therebetween, wherein at least one of said contact surfaces is coated with a low coefficient of friction coating.

14. A sole for an article of footwear, comprising:

a first layer;

a ground-engaging layer;

a transition layer disposed between at least a portion of said first layer and said ground-engaging layer and allowing relative horizontal motion between at least a portion of said first layer and at least a portion of said ground-engaging layer, wherein said transition layer comprises a shear plate assembly, said shear plate assembly comprising an upper plate having a first contact surface, a lower plate having a second contact surface, wherein said upper plate and said lower plate are stacked so that said first contact surface abuts against said second contact surface and said upper plate and said lower plate are joined together to allow relative motion therebetween; and a second layer disposed between said transition layer and said ground-engaging layer.

15. The sole of an article of footwear according to claim 14, wherein the upper plate is rigid.

16. The sole of an article of footwear according to claim 14, wherein the lower plate is rigid.

17. A sole for an article of footwear comprising:

a first layer;

a ground-engaging layer; and a transition layer disposed between at least a portion of said first layer and said ground-engaging layer and allowing relative horizontal motion between at least a portion of said first layer and at least a portion of said ground-engaging layer, wherein said transition layer comprises a shear plate assembly, said shear plate assembly comprising an upper plate having a first contact surface and at least one hole disposed therein, a lower plate having a second contact surface and at least one coordinating hole disposed therein, wherein said upper plate and said lower plate are stacked so that said first contact surface abuts against said second contact surface and said upper plate and said lower plate are joined together to allow relative motion therebetween, and said holes are aligned and a grommet made of a less rigid material than that of said upper plate and said lower plate is disposed within said holes to join said upper plate and said lower plate.

18. The sole for an article of footwear according to claim 17 wherein deformation of said grommet allows for relative motion between said upper plate and said lower plate.

* * * * *